US012281477B2

(12) United States Patent
Ingalls

(10) Patent No.: US 12,281,477 B2
(45) Date of Patent: Apr. 22, 2025

(54) ATTIC STAIR APPARATUS

(71) Applicant: Edwin W. Ingalls, The Villages, FL (US)

(72) Inventor: Edwin W. Ingalls, The Villages, FL (US)

( * ) Notice: Subject to any disclaimer, the term of this patent is extended or adjusted under 35 U.S.C. 154(b) by 0 days.

(21) Appl. No.: 18/957,366

(22) Filed: Nov. 22, 2024

(65) Prior Publication Data

US 2025/0084643 A1 Mar. 13, 2025

Related U.S. Application Data

(63) Continuation of application No. 18/381,585, filed on Oct. 18, 2023.

(60) Provisional application No. 63/417,188, filed on Oct. 18, 2022.

(51) Int. Cl.

| | |
|---|---|
| ***E04F 11/06*** | (2006.01) |
| ***E04F 11/04*** | (2006.01) |
| ***E04F 11/18*** | (2006.01) |

(52) U.S. Cl.

CPC ..... *E04F 11/062* (2013.01); *E04F 11/04* (2013.01); *E04F 11/06* (2013.01); *E04F 11/068* (2013.01); *E04F 11/18* (2013.01); *E04F 11/064* (2013.01); *E04F 11/066* (2013.01)

(58) Field of Classification Search

CPC ..... E04F 11/062; E04F 11/04; E04F 11/06; E04F 11/068; E04F 11/18; E04F 11/064; E04F 11/066; E06C 1/12; E06C 1/383; E06C 9/085; E06C 9/08

See application file for complete search history.

(56) References Cited

U.S. PATENT DOCUMENTS 1,936,929 A * 11/1933 Bessler ..... E04F 11/04 182/80
2,314,004 A * 3/1943 Marschke ..... E04F 11/064 182/78
2,840,289 A * 6/1958 Murray ..... E06C 1/56 182/77
3,521,758 A * 7/1970 Guilfoyle, Sr. ..... F16B 9/054 248/200.1
6,129,179 A * 10/2000 Rooney ..... E06C 1/38 182/195
6,662,901 B1 12/2003 Appl
8,286,752 B2 10/2012 McIntire et al.
(Continued)

*Primary Examiner* — Omar F Hijaz
(74) *Attorney, Agent, or Firm* — Jason T. Daniel, Esq.; Daniel Law Offices, P.A.

(57) ABSTRACT

An improved retractable attic stair apparatus assembly includes a stair component retractable staircase assembly including two shock mount subassemblies, two gas spring subassemblies, and two short railing pipe assemblies. The two short railing pipe assemblies are used as a left and right handrail of the retractable staircase assembly while also supporting the two shock mount subassemblies. The two gas spring subassemblies are at least partially supported by the two shock mount subassemblies. The attic stair apparatus is configured for an installation site in an attic or a garage and includes a first retracted configuration. A deployed configuration allows the apparatus to extend downwardly from the installation site for use of the attic stair apparatus by a user to ascend the attic stair apparatus to access an attic, a garage crawl space, or a garage roof.

15 Claims, 29 Drawing Sheets

(56) References Cited

U.S. PATENT DOCUMENTS

| | | | | |
|---|---|---|---|---|
| 8,763,756 | B1 | 7/2014 | Ski et al. | |
| 8,997,411 | B2 * | 4/2015 | Whitten | E04F 11/064 52/183 |
| 9,540,824 | B1 | 1/2017 | Sandburg | |
| 9,957,720 | B1 * | 5/2018 | Brunner | E04F 11/04 |
| 10,427,761 | B2 | 10/2019 | Grovender | |
| 2005/0029044 | A1 * | 2/2005 | A. Latimer | E06C 1/32 182/78 |
| 2008/0179137 | A1 | 7/2008 | Latimer et al. | |
| 2009/0288351 | A1 | 11/2009 | Burke | |
| 2010/0192487 | A1 * | 8/2010 | Thornton | E04F 11/064 52/741.2 |

* cited by examiner

ATTIC STAIR APPARATUS

CROSS-REFERENCE TO RELATED APPLICATIONS

The present application is a continuation of U.S. patent application Ser. No. 18/381,585 filed on Oct. 18, 2023, which claims priority to U.S. Provisional Application No. 63/417,188 filed Oct. 18, 2022, the contents of each of which are incorporated herein by reference.

TECHNICAL FIELD

The present invention relates generally to attic stairs, and more particularly, to an improved attic stair apparatus.

BACKGROUND

Attic stairs are used to gain access to an attic and are generally configured to be stored in an attic floor when not in use. Though improvements have been introduced to attic stair assemblies, the improvements do not provide solutions to the needs of many human users, particularly the elderly or those lacking upper body strength to operate and control heavy attic stair assemblies.

Existing options are unstable or heavy, are unsafe to operate and deploy, and are unsafe to ascend and descend due to the construction of the stairs. Existing options also take a long time to operate, delaying the user access to the attic.

Providing electrically operated attic stair assemblies may also be unsafe. Electrical parts are likely to wear out or fail causing the stairs to not work or require maintenance. Electrical connections required by electrically operated attic stair assemblies require additional costs to operate the stairs. When there is a power outage, the stairs would not be accessible.

Conventional fold out stairs have multiple sections which must be manually controlled. This may be problematic for individuals who are unable to lift and control heavy, unstable items, including elderly and short individuals. Such stairs may be unsafe to operate and to use. Fold out stair configurations may have springs and may slam shut if the user is unable to control the assembly when closing. A user may be trapped or injured in the springs, hinges and fold out sections that create pinch points for fingers. In use, fold out stairs may be uncomfortable and unsafe, as the user may always need to be on the user's toes and balls of the user's feet.

Available solutions do not solve these problems. Solutions exist which include automated pivoting stairway systems which raise and lower through use of a drive actuator to thereby provide access to above or below floor level areas or between an elevated area and the ground floor. The system may utilize modular sections to allow on-site assembly. The stairway may be pivoted at the top of the stairway by way of a pivot drive lever attached on either side of the top step pivot frame assembly so that access on or off the stairway may be directly off the front end of the stairway, or to either side. A separate frame member may extend from the pivot point along the side of the stairway opening to a predetermined distance. This frame member may serve as the anchor point for the base end mount of the actuator. The actuator controls the length of stroke and the amount of torque that is required to operate the stairway up and down.

Solutions exist which include a hatch box which has four side walls, each having an inside and an outside, wherein a cavity is defined between the inside sides. Further, the floor staircase unit includes a lid secured to the hatch box and pivotable between a closed position covering the cavity and an open position exposing the cavity. Furthermore, the bottom staircase unit includes a walk-on climbing aid fastened to the lid, and an elastic insulating unit comprising a compressible soft foam and a film circulating around the outside of the side walls of the hatch box, the film at least partially surrounding the flexible foam, and wherein the flexible foam is attached directly or indirectly to the hatch box, preferably directly or indirectly fixedly connected to the hatch box.

Solutions also exist which include stairs pivotable from a lowered position allowing a user to climb the stair from a lower level to an upper level, into a stowed position wherein the stair is lifted from the lower level so that the plane of the stair is approaches a ceiling situated between the lower and upper level. Some options include stairs which do not fold and may rotate between the lowered and stowed positions about a pivot fixed in association with the ceiling. A drive cable may be anchored to a surrounding structure in an upper level and may extend from the stair top or from a drive arm extending from the stair top. A drive motor drives the drive cable to draw the stair top downwardly, thereby raising the stair bottom about the pivot.

Some options include a unitary stairway (as distinguished from a sectional folding stairway) adapted to assume an inclined operative position and an upper horizontal inoperative position above a ceiling of a room. Hydraulic means may impart longitudinal forces to the stairway to move it upwardly or downwardly, and rails carried by the stairway are engageable in guide rollers to guide the stairway between operative and inoperative positions. A wall switch may be provided to energize a motor for driving a pump to generate power in the hydraulic means.

A solution is needed which provides an improved attic stair assembly that is safe, economical, and easy to operate and maintain. A solution is needed that provides a manually retractable set of stairs that includes safety rails and is capable of being safely and quickly folded in and out of an attic. A solution is needed that may be safely and comfortably ascended and descended to access a user's attic. A solution is needed that may be easily and economically maintained and may remain accessible to the user for use at all times.

Accordingly, there is need for a solution to at least one of the aforementioned problems. For instance, there is an established need for an improved manually operable attic stair assembly which provides a manually retractable set of stairs and handrails, which is capable of folding in and out of the attic. There is a need for an assembly which provides safe comfortable stairs, provided as an integral unit retractable as a whole.

SUMMARY OF THE INVENTION

This summary is provided to introduce a variety of concepts in a simplified form that is further disclosed in the detailed description of the embodiments. This summary is not intended for determining the scope of the claimed subject matter.

The present invention is directed to an improved attic stair apparatus. The attic stair apparatus includes a manually retractable set of stairs with metal handrails. The manually retractable stair apparatus is capable of moving in and out of the attic. The stair apparatus is more stable, with a stair assembly comprising a plurality of 5.5 inch length steps configured to provide a comfortable foot fitting. Moreover, the plurality of steps includes steep angles in contrast to other stairs on the market. The plurality of steps will be provided in a single solid piece; not foldable, only retractable as a whole unit.

In one aspect, the stair apparatus includes incorporated gas shocks mechanics (not spring loaded, meaning it will not spring forward, but pressurized to exert a spring-like action. from the gas pressure) to allow the stair apparatus to both slowly go up without slamming and go down without applying too much force.

In a first implementation of the invention, the present invention provides a retractable staircase apparatus including: a stair assembly, two shock mount subassemblies, two gas spring subassemblies, and two short railing pipe assemblies. The gas springs are the only controlling devices and provide pressure to hold the stair assembly both open and closed based upon the designed geometry of the shock mount assemblies. The gas shocks also provide a controlled soft closing safety feature which prevents the stair apparatus from slamming shut. The two short railing pipe assemblies may be used as left and right handrails of the stair assembly of the retractable staircase apparatus, while also supporting the two shock mount subassemblies. The two gas spring subassemblies may be at least partially supported by the two shock mount subassemblies. The railing pipe assemblies may be designed to be preloaded with an upward tensioning force to assist in supporting the middle of the stair stringers thus transferring load back to the shock mount subassemblies. This unprecedented configuration permits such a long and heavy stair assembly to be precisely and safely controlled by the shock mount subassemblies from one end of the stair assembly with no cables or other such mechanism along the length of the stair assembly, which makes the stair apparatus of the present invention much safer and easier to use than previous solutions.

In one aspect, the stair apparatus includes no electrical components and is entirely manually operable.

In one aspect, the stair apparatus is configured to be opened and closed quickly with ease, without the application of force by the user. The stair apparatus may be opened in 8 seconds or less.

In one aspect, the stair apparatus easily opens and closes. A user may open and close the stair apparatus with little effort.

In one aspect, the apparatus of the present invention may include a stair assembly further comprising a plurality of steps. Each step of the plurality of steps may be configured to provide wide steps having a width of about 5.5". The stair assembly may further include a plurality of steps wherein each step of the plurality of steps further includes a front step extension providing an additional 1.5 to 2" in a front position of each step, so that a full 7 to 7.5" step is provided for a user's foot to comfortably engage. In some embodiments each step of said plurality of steps may have a step dimension of between about 7 to 7.5".

In one aspect, the stair apparatus may be provided as a preassembled stair apparatus.

In some embodiments, the apparatus of the present invention may be provided fully assembled and ready to be installed or may be ordered with installation included.

In a second implementation, the apparatus of the present invention may be provided in a kit for use by do it yourselfers or handy persons, carpenters, builders, or the like to build and install. The kit may include all necessary components, hardware, instructions, templates, gas shocks, fasteners, or the like, to construct the stair apparatus. In some embodiments, the user builder may obtain the wood from their local lumber supplier and construct the stair assembly using the templates and instructions provided in the kit. In some embodiments, the kit may be provided with a fully assembled stair assembly. In other embodiments, the kit may include parts for the user to assemble the stringers and steps to provide a stair assembly.

In another aspect, the stair apparatus may be provided as a kit comprising the components of the stair apparatus for assembly, which a user may assemble. The kit may include the metal components (including handlebars, shock absorber mechanism, screws, tools, and the like). The kit may include a user guide providing detailed instructions to build the stair assembly themselves from scratch. In some embodiments, the user may purchase their own lumber from a local woodshop or lumber yard to construct the stair assembly. In other embodiments, a pre-assembled stair assembly may be provided with the kit.

In one aspect, the apparatus is manually operated and is not powered by electricity. There are no electrical parts to wear out or fail causing the stairs to not work or require maintenance. There are no electrical connections to a home so there are no additional costs to operate the stairs for electricity.

The apparatus is available to the user at all times, 24/7/365 because the apparatus is manually operable. If there is an electrical power outage, the apparatus remains accessible for use.

In one aspect, the apparatus uses gas shocks instead of springs or electrical motors.

In one aspect, the apparatus opens and closes easily and quickly. The apparatus includes no springs, hinges or fold out sections, and may simply be pulled down and will stay down during use. When the user wishes to close the apparatus, the gas shock design closes the stair assembly quickly but softly with a slight push up without slamming.

In one aspect, the present invention distinguishes over previous fold out stairs which have springs and can slam shut if not controlled when closing. The present invention distinguishes over fold out stairs which have springs, hinges and fold out sections that are pinch points for fingers and unwieldy to open, in particular if the user is shorter in height.

In one aspect, the apparatus of the present invention includes a stair assembly comprising a plurality of steps each having a width of about 5.5" The apparatus of the present invention distinguishes over previous solutions which provide narrow steps having a width of about 3 to 4".

In one aspect, the stair assembly includes a plurality of steps each further comprising a front step extension of between 1.5 to 2", whereby each step is configured to provide a full 7 to 7.5" for a foot of any user of all ages to comfortably and safely engage the step. The apparatus of the present invention distinguishes over previous uncomfortable and unsafe solutions wherein a user must be supported by the user's toes and balls of the foot.

In one aspect, the apparatus of the present invention is configured to open or close in up to about 8 seconds.

In one aspect, the apparatus of the present invention provides an unprecedented retractable stair apparatus in which the stair assembly includes a full solid stringer (the side of the stair that the steps are bolted to), so that the stair assembly is constructed and arranged like a conventional set of stairs that are built into a building and fixed in place.

In one aspect, the present invention distinguishes over previous solutions which include a fold out stringer or a slide out stringer, which are susceptible to movement and makes the previous types of stairs feel less stable and comfortable to walk up or down.

In a third implementation, the present invention may provide a method for assembling the stair apparatus.

These and other objects, features, and advantages of the present invention will become more readily apparent from the attached drawings and the detailed description of the preferred embodiments, which follow.

BRIEF DESCRIPTION OF THE DRAWINGS

A complete understanding of the present embodiments and the advantages and features thereof will be more readily understood by reference to the following detailed description when considered in conjunction with the accompanying drawings wherein:

FIG. 18 presents a schematic view of installation of an attic stair apparatus as in

FIG. 11;

FIG. 19 presents a schematic view of installation of an attic stair apparatus as in

FIG. 11;

FIG. 21 presents a schematic view of installation of an attic stair apparatus as in

FIG. 11;

FIG. 31 presents a schematic view of the installation of an attic stair apparatus as in

FIG. 11;

DETAILED DESCRIPTION

Figure 1:
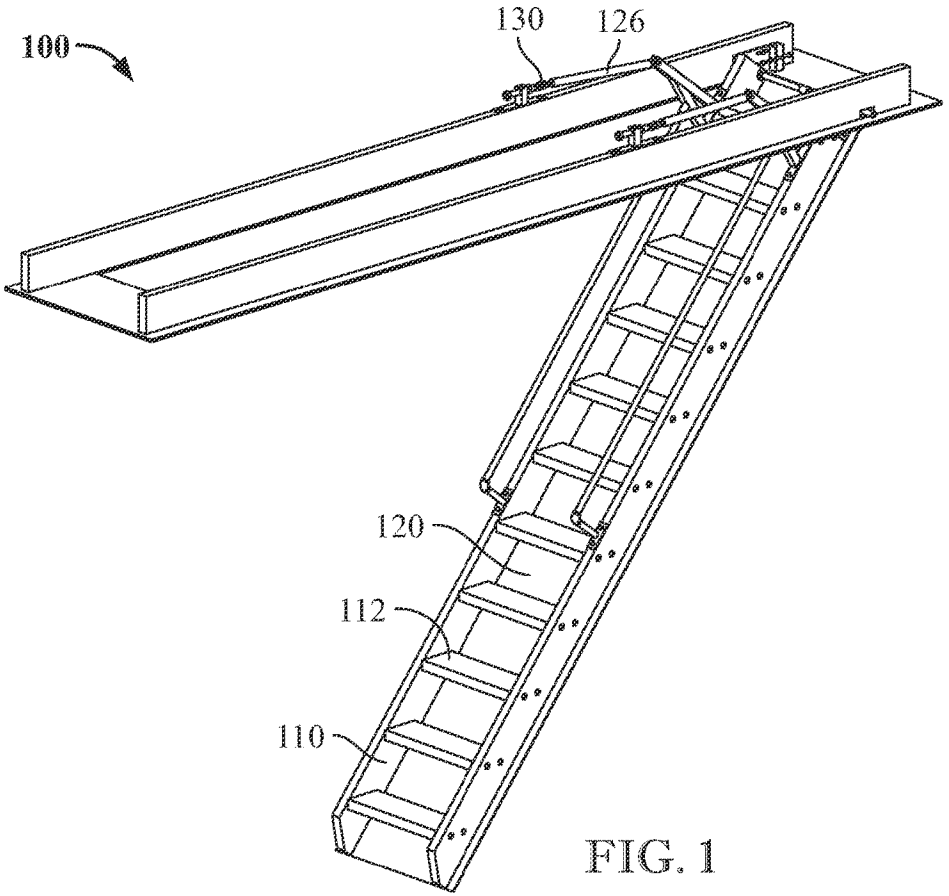
FIG. 1 presents a perspective view of an installed attic stair apparatus in accordance with a first implementation of the present invention, showing the apparatus deployed for use.
Figure 2:
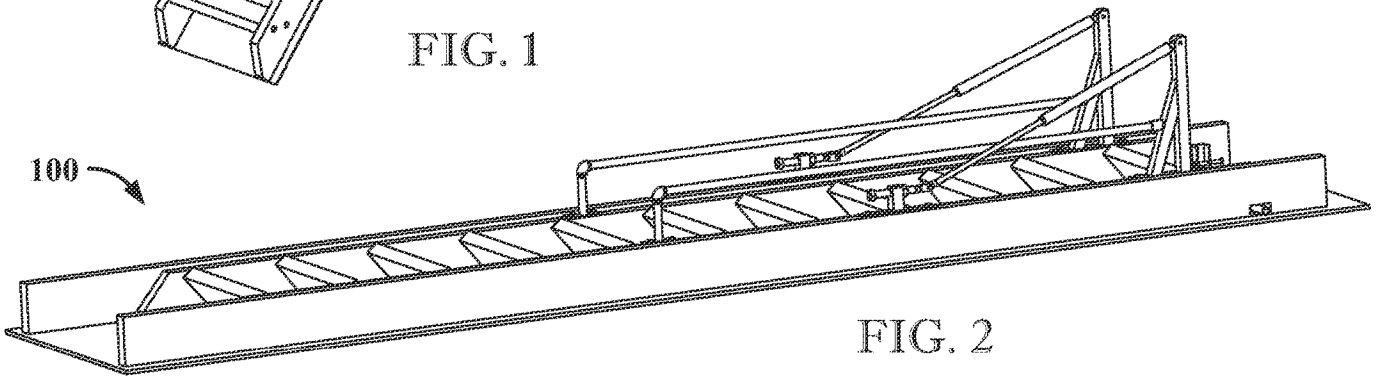
FIG. 2 presents a perspective view of a retracted attic stair apparatus in accordance with the present invention.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems.

Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Shown throughout the figures, the present invention is directed to a fixed-shape manually retractable attic stair apparatus. The attic stair apparatus includes a manually retractable set of fixed-shape stairs (also referred to as stair assembly) and handrails. The stairs may be made of any suitable material such as, for example without limitation, wood, metal, plastic, or the like. The manually retractable stair apparatus is capable of folding in and out of an attic. A stair assembly includes a plurality of steps which provide a comfortable, stable and safe footing for a user. The stair assembly may be provided in a single solid piece which is not foldable and is retractable as a whole unit.

As shown in the figures, the attic stair apparatus 100 can include one or more of the following components and combinations thereof: at least one stringer 110, at least one stairstep 112, a backing 120, at least one gas spring 122, at least one male clevis 130, at least one female clevis 132, at least one fixed mount 140, a stationary adjustable joist plate 142, a sliding adjustable joist plate 144, at least one stringer plate 150, at least one joist plate 152, a left-hand large spring mount 154, a righthand large spring mount 156, at least one Sch. 40 Pipe—End mount 160, at least one Sch. 40 Pipe—Elbow 162, at least one Sch. 40 Pipe—Handrail 164, a clamping two-piece shaft collar 170, a merchant coupler 172, at least one Sch. 40—½" black pipe (hinge bar) 174, at least one ⅜" lag, L25 in 176, at least one ⅜" lag, 3 in 178, at least one ⅜" lag, 4 in 180, at least one ¾" Bolt, Sin 182 at least one ¾" Nut 184, a ⅜" bolt, 3.5" 186, at least one ⅜" nut 188, and at least one ⅜-16 threaded rod 190

These components may be made of any suitable materials and fabricated by any suitable fabrication process. These components may further have any suitable dimensions. The dimensions listed are nonlimiting examples.

As can be seen at FIGS. 6-7, 20-21, 20-22, 24, and 27-29, the joist plate 152 may have any suitable configuration, nonlimiting examples of which are shown at FIGS. 6-7, 20-21, 20-22, 24 and 27-29.

With continued reference to the figures, the attic stair apparatus 100 may include the following components: two stringers 110, eleven stairsteps 112, one backing 120, two gas springs 126, three male clevises 130, four female clevises 132, two fixed mounts 140, one adjustable joist plate-Stationary 142, one adjustable joist plate-Sliding 144, two stringer plates 150, one joist plate 152, one large left-hand spring mount 154, one large righthand spring mount 156, two Sch. 40 Pipe—end mounts 160, two Sch. 40 Pipe—elbows 162, two Sch. 40 Pipe—handrails 164, one clamping two-piece shaft collar 170 one merchant coupler 172, two Sch. 40, ½" black pipes (hinge bars) 174, eight ⅜" lags, 1.25 in 176, twelve ⅜" lags, 3 in 178 forty four ⅜" lags, 4 in 180 two ¾" bolts, Sin 182, two ¾" nuts 184, one ⅜" bolt, 3 5" 186 three ⅜" nuts 188, and two ⅜-16 threaded rods 190.

These components may be made of any suitable materials and fabricated by any suitable fabrication process. These components may further have any suitable dimensions. The dimensions listed are nonlimiting examples.

Referring to FIGS. 1-12, an attic stair apparatus 100, is illustrated in accordance with a first exemplary embodiment of the present invention. The apparatus 100 may include a stair body having two stringers 110 and a plurality of stairsteps positioned between the stringers extending from the top end to the bottom end of the stair body. The apparatus 100 may further include a backing 120 made of any suitable material. For example, without limitation, the backing 120 may be a backing made of wood.

The apparatus may further include two (2) gas springs 126, clevises 130 and 132, two fixed mounts 140, one stationary adjustable joist plate 142, and one sliding adjustable joist plate 144. Two stringer plates 150, one joist plate 152, one large left-hand spring mount 154, one large right-hand spring mount 156, two (2) Sch. 40 Pipe—end mounts 160, two Sch. 40 Pipe—elbows 162, two Sch. 40 Pipe—handrails 164, one clamping two-piece shaft collar 170, one merchant coupler 172, and two (2) Sch. 40, ½" black pipes (hinge bars) 174.

The apparatus 100 may include a plurality of mechanical connectors or fastening means. For example, without limitation, in one embodiment, the apparatus may include eight (8) ⅜" lags, 125 in 176, twelve (12) ⅜" lags, 3 in 178, forty-four (44) ⅜" lags, 4 in 180, two (2) ¾" bolts, Sin 182, two (2) ¾" nuts 184, one ⅜" bolt, 3.5" 186, three (3) ⅜" nuts 188, and two (2) ⅜-16 threaded rods 190.

Figure 3C:
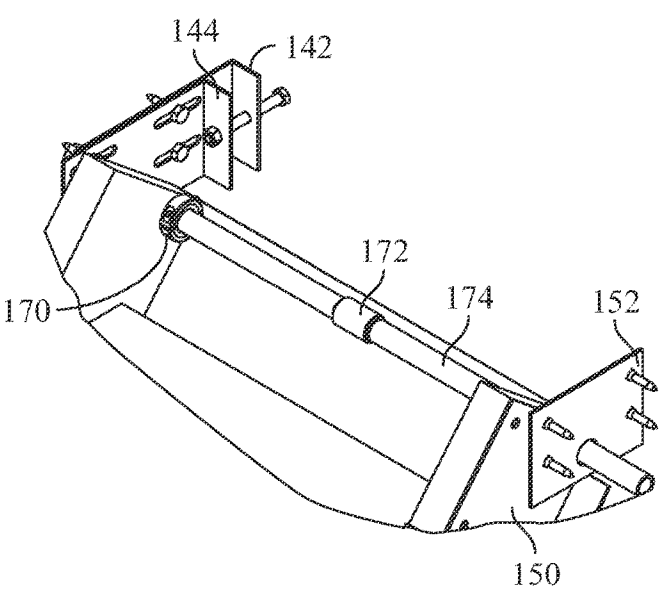
FIG. 3C presents a partial view of a deployed attic stair apparatus taken along circle 3C of FIG. 3.
Figure 3B:
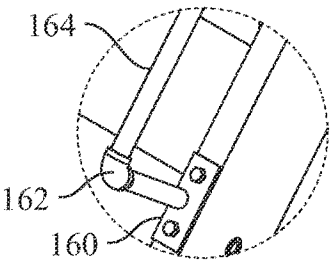
FIG. 3B presents a partial view of a deployed attic stair apparatus taken along circle 3B of FIG. 3.
Figure 3A:
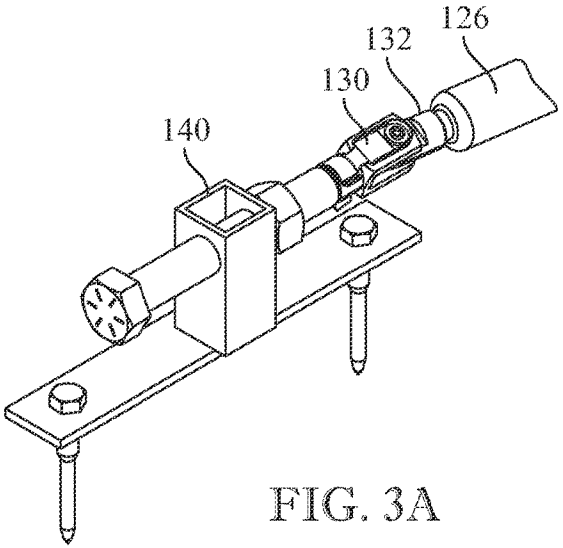
FIG. 3A presents a partial view of a deployed attic stair apparatus taken along circle 3A of FIG. 3.
Figure 3:
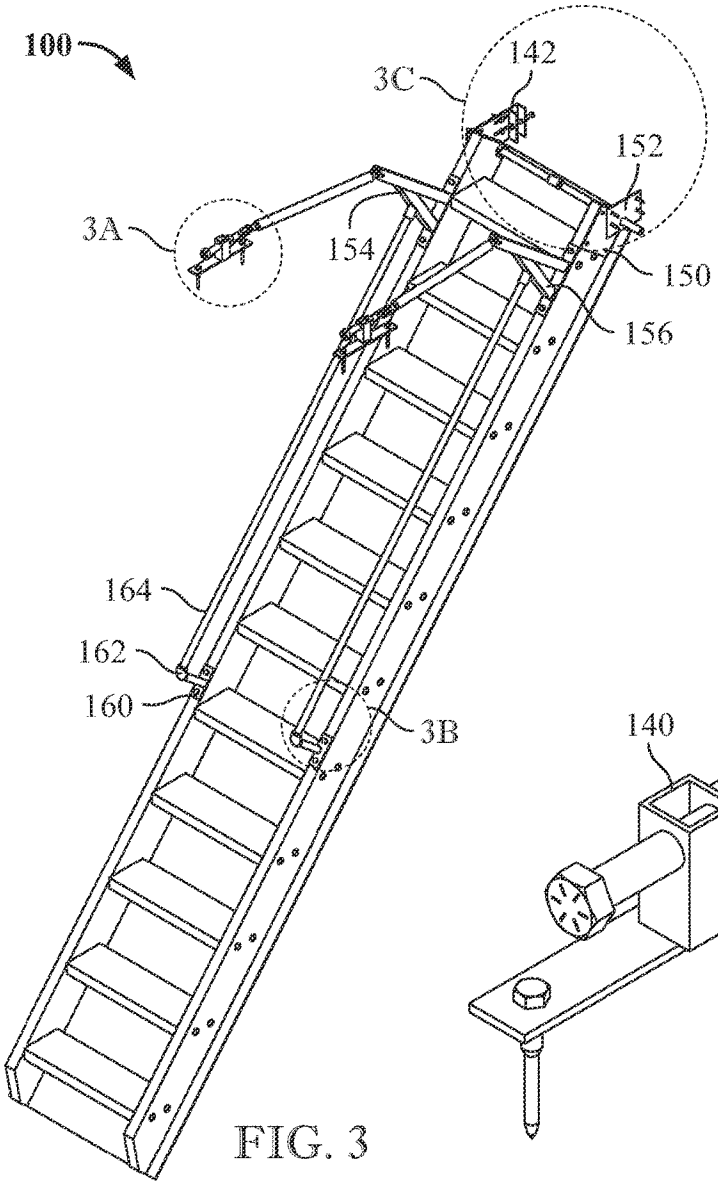
FIG. 3 presents a perspective view of a deployed attic stair apparatus in accordance with the present invention.
Figure 4B:
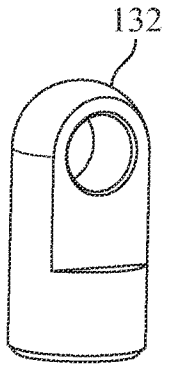
FIG. 4B presents an enlarged cutout view of the female clevis shown in FIG. 4, in accordance with the present invention.
Figure 4A:
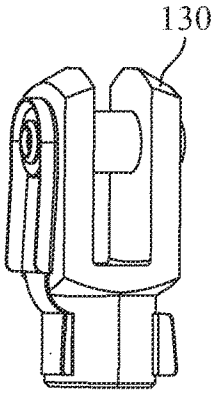
FIG. 4A presents an enlarged cutout view of the male clevis shown in FIG. 4, in accordance with the present invention.
Figure 4:
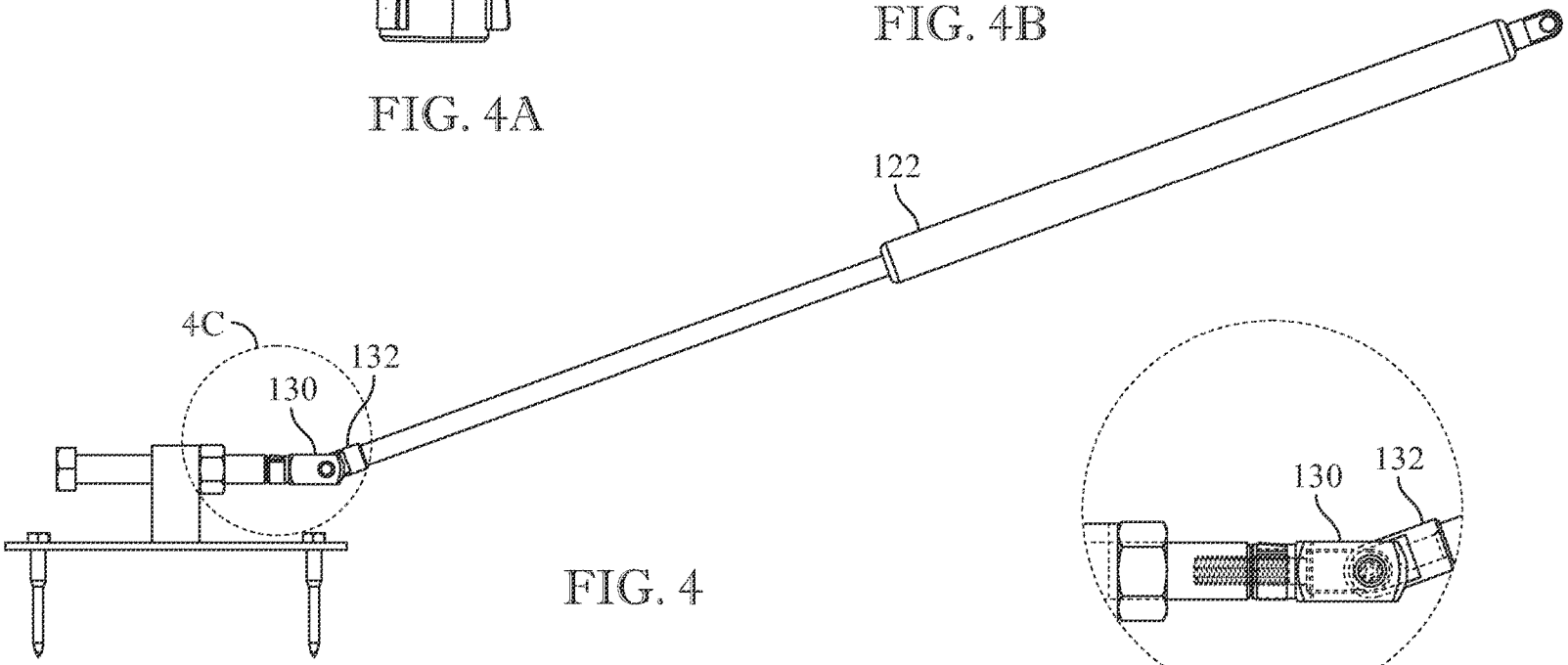
FIG. 4 presents a perspective view of a gas spring assembly of the attic stair apparatus in accordance with the present invention.
Figure 4C:
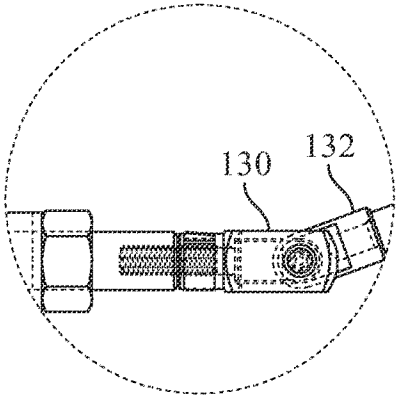
FIG. 4C presents an enlarged detail view of the male and female clevis in an assembled orientation as shown in FIG. 4, in accordance with the present invention.
Figure 9:
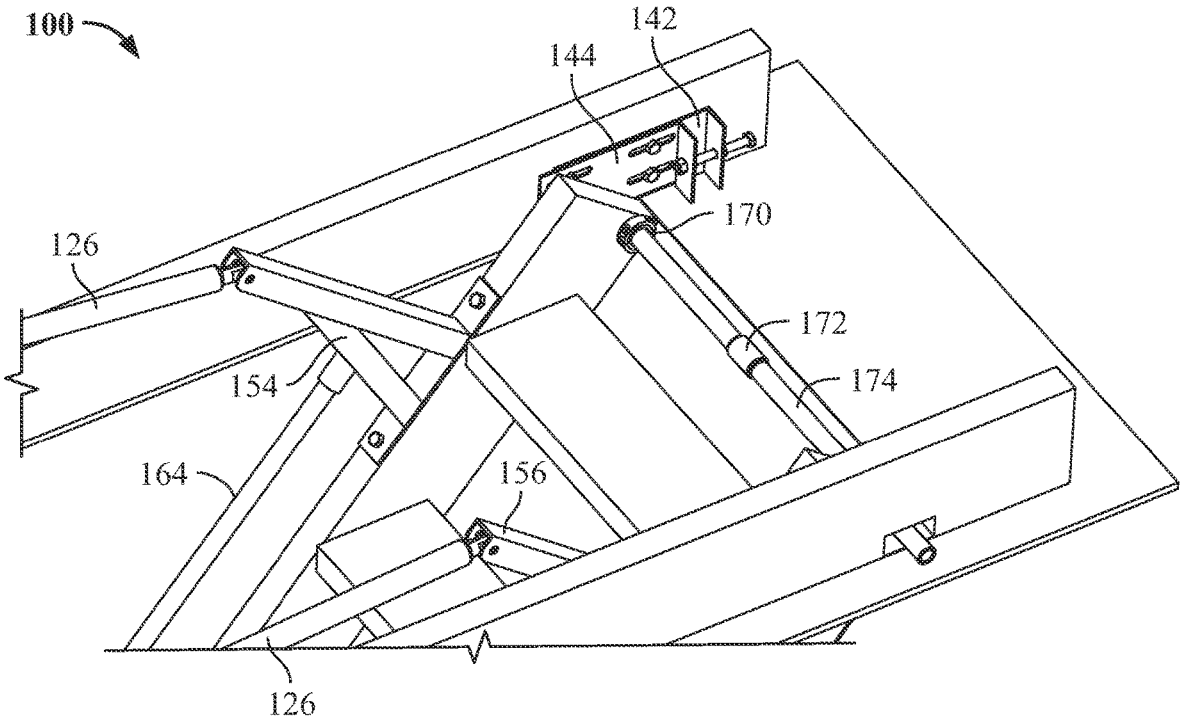
FIG. 9 presents a perspective view of a hinge bar assembly of the attic stair apparatus in accordance with the present invention.
Figure 10:
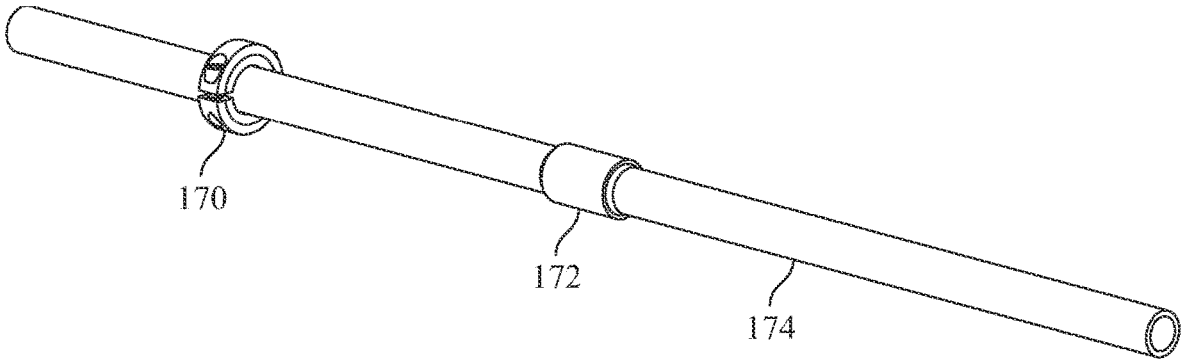
FIG. 10 presents a perspective view of a gas spring mount and a railing assembly of the attic stair apparatus in accordance with the present invention.

As shown best at FIGS. 3 and 9, joist plates 152 and 154 are positioned along the top edge of the stair body (e.g., stringers, steps, and backing) adjacent to the top step. The joist plates secured the stair body into the rafters of the building, and elements 170, 172 and 174 form a hinge in conjunction with the plates to allow the stairs to rotate/pivot between the open position shown at FIG. 11 and the closed position shown at FIG. 15.

Unlike traditional attic stairs which utilize spring-loaded hinges at the top end that require the stair body to be folded in half to transition between an open and closed position, the inventive apparatus utilizes a novel offset tensioner that provides a tension/resistance that is strong enough to allow a user to easily transition the stairs between the open position and the closed position without requiring the shape of the stair body to be folded or otherwise manipulated.

Figure 16:
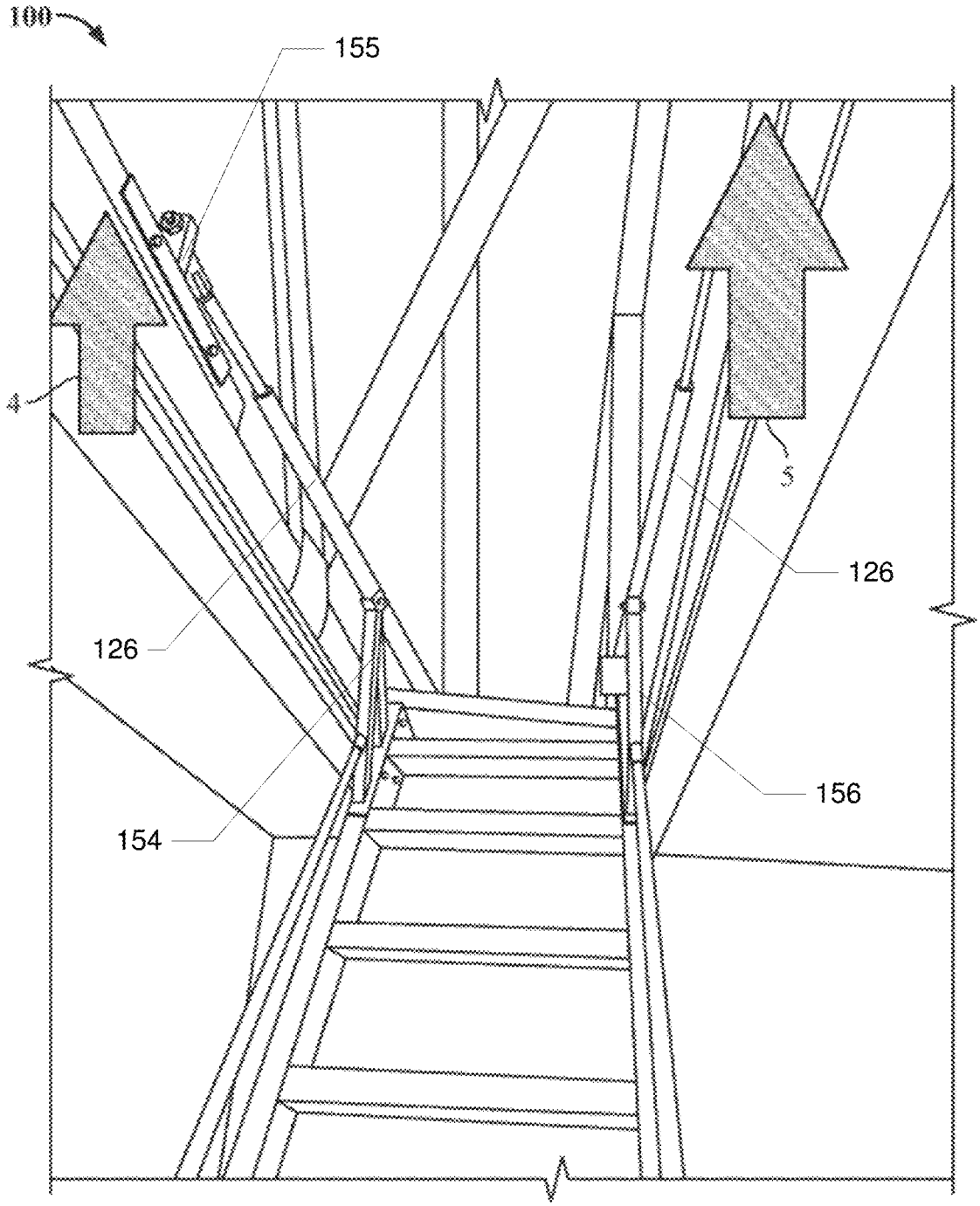
FIG. 16 presents a schematic view of a retractable attic stair apparatus as in FIG. 11.

As shown best at FIGS. 3, 9 and 16, the offset tensioner can include a pair of spring mounts 154 and 156 are positioned along the stringers on both sides of the stair body. The mounts extend perpendicularly outward from the stringers and are separated from the hinge mechanism and associated joist plates by a predetermined distance.

As shown best at FIG. 16, a pair of elongated springs 126 can be connected to the distal ends of the mounts 154/156 and can extend longitudinally away from the hinge mechanism in a direction toward the bottom end of the stairs when they are in the closed position. The ends of the springs are connected to rafter mounts 155.

In the preferred embodiment, the rafter mounts are positioned about ⅓ the length of the stair body, and the springs are sized to accommodate this distance. This positioning combined with the offset location of the spring mounts 154/156 relative to the hinge mechanism creates a large fulcrum leverage area that permits the stair body to easily move between the open and closed positions with a pulling force of between about 2 and 5 foot pounds of strength. Such a force being equivalent to the pulling force of traditional folding attic stairs.

In addition to the above, the handrails 164 can extend from the center portion of the upper spring mounts to a position about ⅔ the length of the stair body. The handrails functioning to provide lateral stability to the stair body in the lowered position, and to ensure alignment with the rafters when in the closed position.

Figure 11:
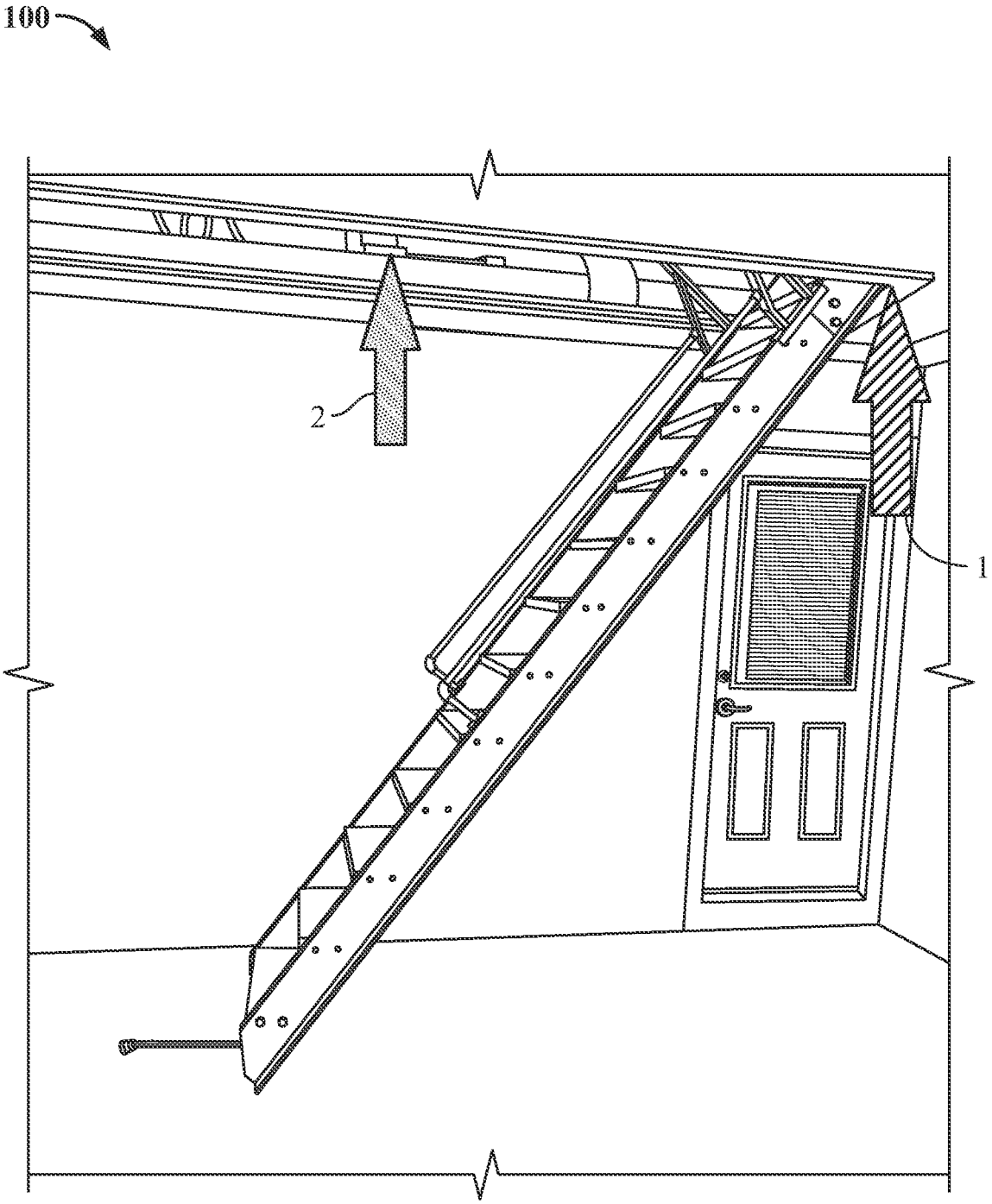
FIG. 11 presents a schematic view of a retractable attic stair apparatus 111 an installation site in accordance with a kit in accordance with a second illustrative embodiment of the present invention, and an installation method in accordance with a third illustrative embodiment of the present invention.
Figure 12:
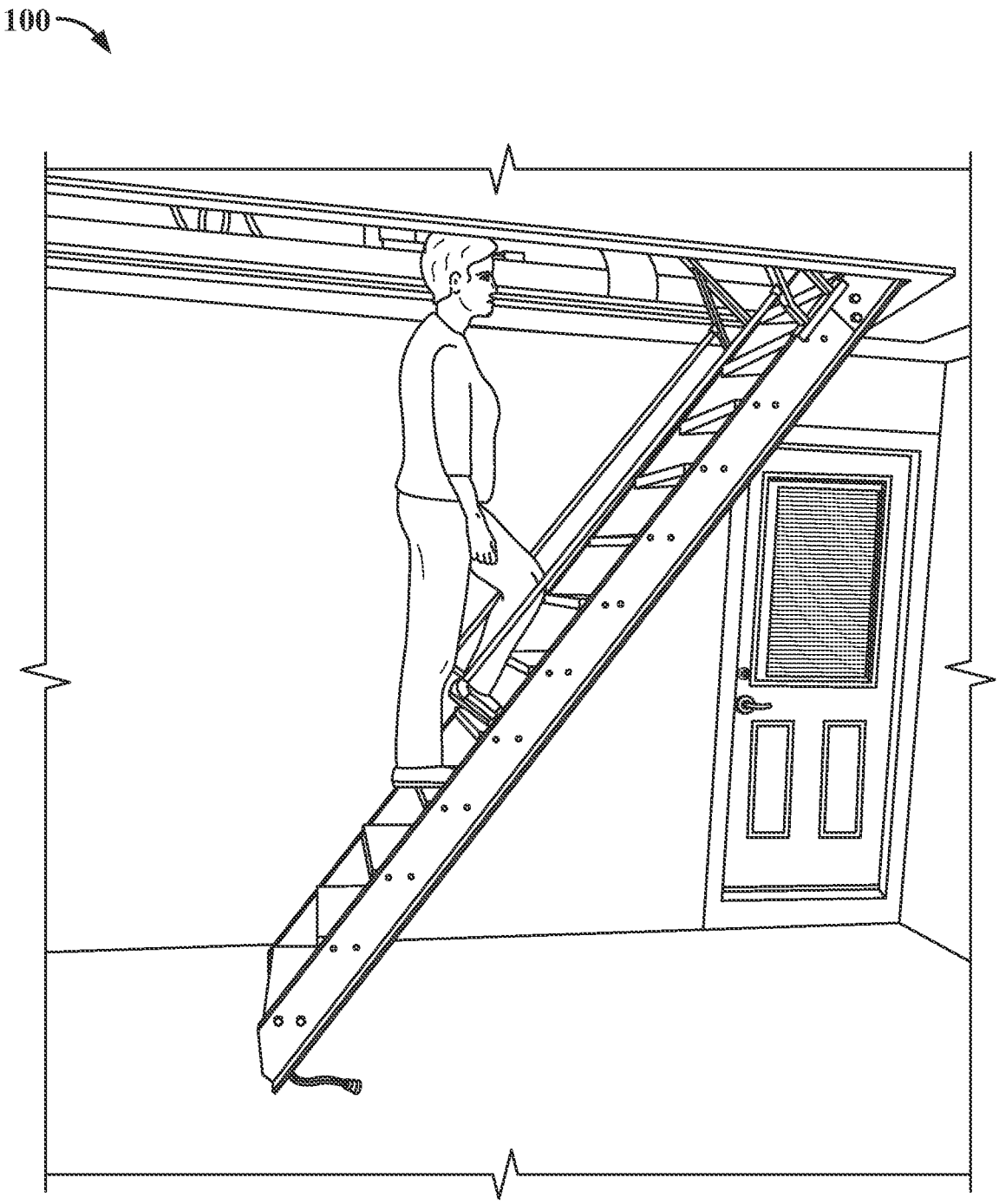
FIG. 12 presents a schematic view of a user ascending installed retractable attic stair apparatus.

The attic stair apparatus 100 may be installed in any suitable structure. An example of an installed apparatus 100 is shown at FIG. 11. FIG. 12 presents a schematic view of a user ascending an installed retractable attic stair apparatus.

In a second implementation, the attic stair apparatus of the present invention may be provided in a kit 200 for use by do it yourselfers or handy persons, carpenters, builders, or the like to build and install. In a third implementation, the present invention may provide a method 300 for construction and installation of the attic stair apparatus, using the attic stair apparatus kit 200.

The kit 200 may include all necessary components, hardware, instructions, templates, gas shocks, fasteners, or the like, to construct the stair apparatus. In some embodiments, the user builder may obtain the wood, metal or other building materials, from their local lumber supplier and construct the stair assembly using the templates and instructions provided in the kit. In some embodiments, the kit may be provided with a fully assembled stair assembly 114.

In addition to the stair assembly, an apparatus kit 200A may include the following components: two Stringers 110, one Backing 120 two Gas Springs 126, three Male Clevises 130, four Female Clevises 132, two Fixed Mounts 140, one Stationary Adjustable Joist Plate 142, one Sliding Adjustable Joist Plate 144, two Stringer Plates 150, one Joist Plate 152, one Large Lefthand Spring Mount 154 one Large Righthand Spring Mount 156 two Sch. 40 Pipe—End mounts 160, two Sch. 40. Pipe—Elbows 162 two Sch. 40. Pipe—Handrails 164, one Clamping Two-Piece Shaft Collar 170, one Merchant Coupler 172, two Sch. 40, ½" Black Pipes (Hinge Bars) 174 eight ⅜" lags, 1.25 in 8 176, twelve ⅜" lags, 3 in 12 178 forty four ⅜" lags, 4 in 180 two ¾" Bolts, Sin 182, two ¾" Nuts 184, one ⅜" Bolt, 3.5" 186 three ⅜" Nuts 188, and two ⅜ 16 Threaded Rods 190.

Figure 13:
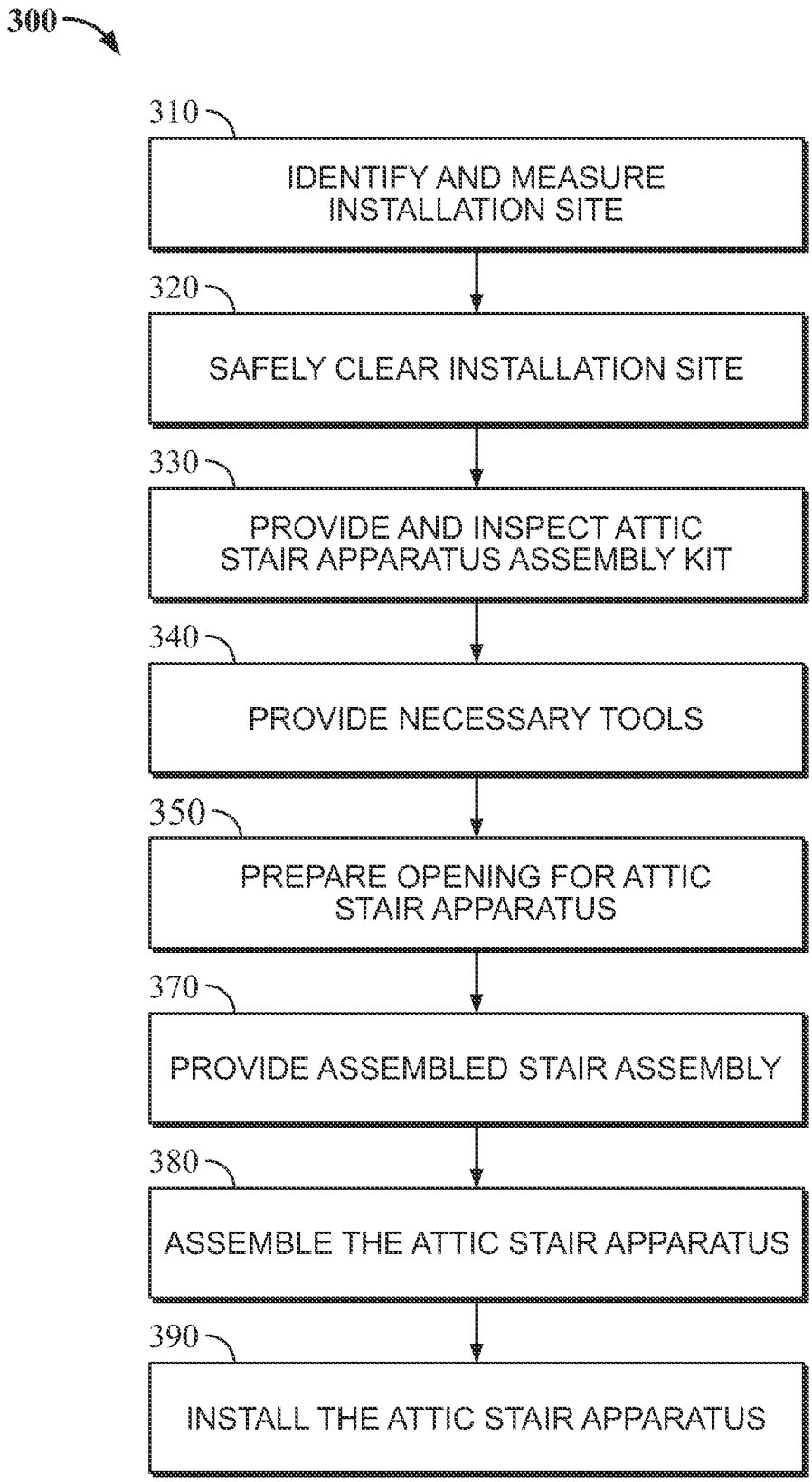
FIG. 13 presents a flow chart of an assembly method in accordance with a third illustrative embodiment of the present invention.

In a third implementation, the present invention may provide a method 300 for installing an attic stair apparatus 100. According to the method 300, an attic stair apparatus kit 200 may be provided. Referring now to FIG. 13, the method 300 for installation of the attic stair apparatus may include one or more of the following steps and combinations thereof. It is noted that some assembly steps may be performed in a different order. In step 310, identify the installation site at which the attic stair apparatus is to be installed, and measure the dimensions of the installation site to make sure the stair assembly will fit in the site, and to identify an intended rough opening for the stair assembly in a ceiling at the installation site, which may be an opening from which an existing set of stairs is to be removed.

In step 320, clear the installation site of unwanted or unnecessary items, making sure any power cords, television cables, gas lines, telephone lines, etc. are cleared, repositioned or safely stowed. In step 330, provide an attic stair apparatus assembly kit appropriately sized for the installation site and check to confirm all of the kit components are present.

In step 340, provide necessary tools, and in step 350, prepare a stair opening for the attic stair apparatus. For a new stair opening, mark the dimensions for the stair opening on the ceiling, which will accommodate the stair assembly, and cut an opening and remove the sheetrock between the joists to provide a ceiling opening to the attic space that is the width of the joists and the length of the stairs plus 1" to accommodate the attic stair apparatus. For an existing stair opening, remove any currently installed staircase and measure and modify the opening as necessary to accommodate the stair assembly.

In step 370, provide an assembled stair assembly, by either providing a preassembled stair assembly, or obtaining the necessary lumber and assembling the stair assembly. In step 380, assemble the attic stair apparatus. In step 390, install the attic stair apparatus in the opening at the installation site, then confirm the stair assembly is properly centered, and adjust the position of the attic stair apparatus as needed.

Figure 14:
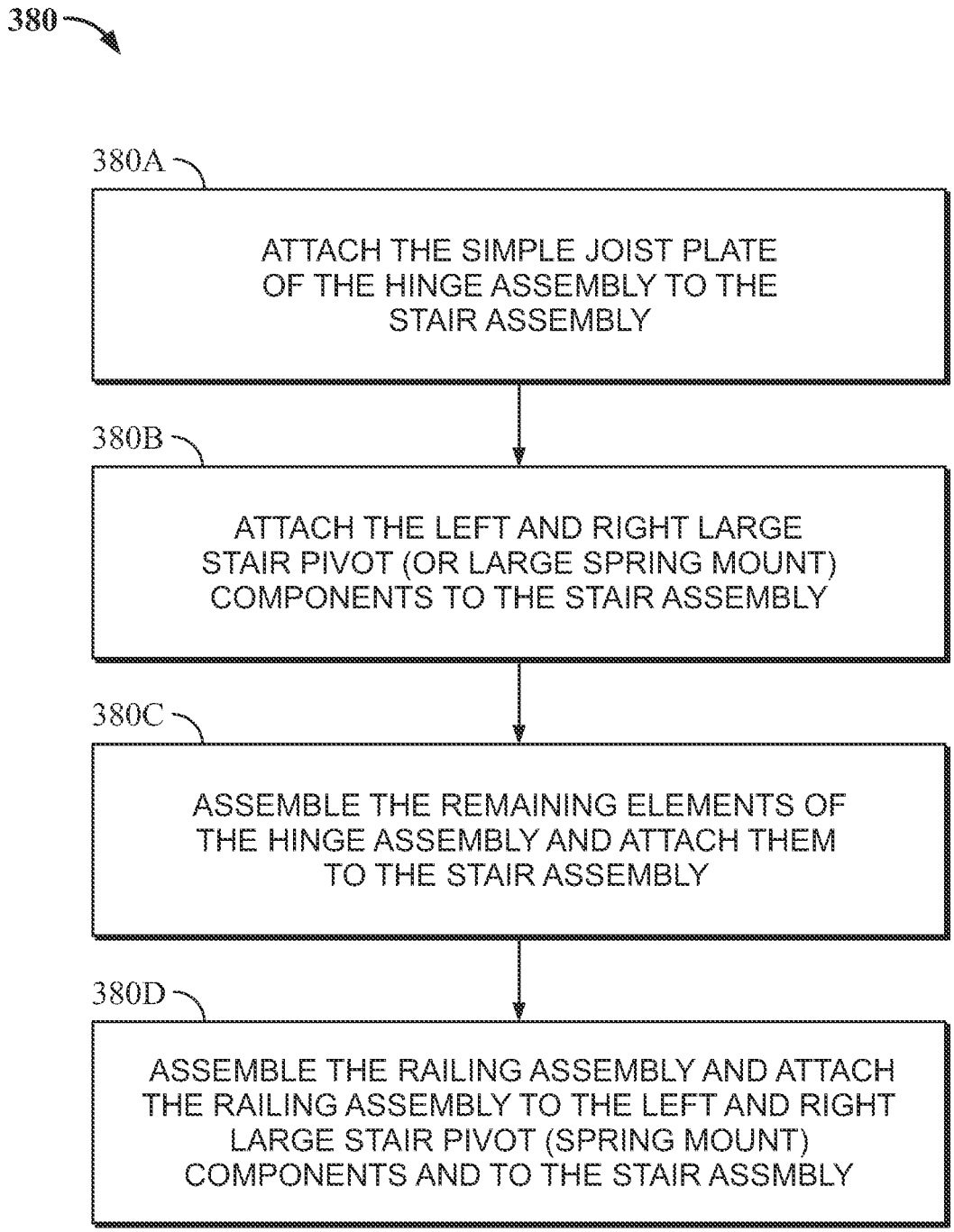
FIG. 14 presents a flow chart of a substep of the assembly method as in FIG. 13.

Referring to FIG. 14, the step of assembling the attic stair apparatus may include one or more of the following attic stair apparatus assembly sub steps and combinations thereof (not necessarily in the order presented): First, attach the joist plate of the hinge assembly to the stair assembly; Attach the left and right large stair pivot or large spring mount components to the stair assembly; 380-C Assemble the remaining elements of the hinge assembly and attach to the stair assembly; and 380-D Assemble the railing assembly and attach the railing assembly to the left and right large stair pivot or large spring mount components and to the stair assembly.

In step 350, (see above) if an opening in the ceiling to receive the attic stair apparatus has not yet been provided, make an opening in the ceiling at the installation site to accommodate the attic stair apparatus, or remove an existing set of stairs.

An embodiment of the assembly and installation method will be further described with reference to FIGS. 11-12 and 15-34.

The method for installation of the attic stair apparatus is described generally with reference to installation of the attic stair apparatus in a home with a ceiling height between T 6" and 8'6" and a dimension of 22" between the joists. As noted, hereinbelow, further reference to installation in structures with ceilings of other heights is provided.

Components of different dimensions would be needed for structures having a ceiling height is taller than 8'6" or shorter than 7'6". Further, as described more fully hereinbelow, for structures having ceiling joists wider or narrower than 22", a user or installer would need to adjust any measurements described herein by the same delta between 22" and the measured joist width. Failure to adjust the measurements accurately would result in the stairs not fitting or functioning properly.

There may be multiple kits 200 for the attic stair apparatus. For example, without limitation, the kits may include a kit 200A for ceiling heights of 8 feet, a kit 200B for ceiling heights of 9 feet, and a kit 200C for ceiling heights of 10 feet. It is important that the kit 200 be obtained for the correct ceiling height. To determine the correct kit 200 the user should measure from the floor to the ceiling and purchase the kit that is closest to the dimension of the measured ceiling height. If the ceiling height is in between these dimensions, then the user may select the kit that is closest to the ceiling height. For example, without limitation, if the user's measured ceiling height is 8' 6.75" or under, then a kit 200A for use with an eight-foot ceiling may be selected. If the measured ceiling height is between 8' 7" and 9'6.75" then a kit 200B for a 9-foot ceiling may be selected. If the measured ceiling height is greater than 9'6.75" but less than 10' 7" then a 10' kit 200C may be selected. If the measured ceiling is greater than 10'7" a custom kit 200D, may be obtained.

The attic stair apparatus kit 200 provides a set of hardware parts required to build the attic stair apparatus to provide a set of retractable stairs in accordance with the present invention.

Next, the necessary tools and building components are obtained or provided.

The tools and all the components necessary to complete the build of the stairs or installation may be separately provided. A user or installer may need to obtain the following equipment for use in construction and installing the attic stair apparatus.

The following is a minimum list of tools required to build and install the Manually retractable attic stair apparatus. If the user does not have these tools available, the user should not attempt to build or install the manually retractable attic stair apparatus.

Circular saw-Table saw, or radial arm saw will be of benefit if available. Framing Square and Tri Square.

Socket set and/or wrenches 7/16" ½", and 19/16"

⅜" drill motor-cordless or corded

5/1 6" drill bit

1" hole saw bit

Sawzall or multi tool to cut sheetrock

Phillips hit for drill tape measure miter box and saw hoist capable of lifting at least 500 lbs.

strap to connect hoist to stairs

Strap or chain to connect hoist to roof trusses 2-8" inch or larger pipe wrenches adjustable wTench (crescent wrench)

set of Allen wrenches general hand tools like hammer, screwdrivers, etc.

The following building materials or components are necessary.

Three (3)-2×6×12 premium grade pine or similar boards. The user or installer should make sure the boards are straight and knot free. It is important that both of the 2×6 boards used for the stringers be absolutely straight both up and down and side to side. If these boards are not straight the resulting stairs will not fit properly and therefore will not fold up into the ceiling properly. Additionally, obtain boards that are as free of large knobs and flaws as possible. Large knots and flaws can cause the stairs to fail under load.

One (1)—4'×8' sheet of \.1,i" backing or similar plywood. It is recommended that this be sanded on at least one side to provide for a good finish.

One (1)—2×4×24".

One (1)—piece of trim that is approximately 1"×⅜"×24" long. Two (2) 1"×4"×12' pine board or similar for trim.

One (1)—1"×4"×6' pine board or similar for trim.

Once the user or installer has obtained the above wood components and has the proper ceiling height attic stair apparatus kit 200 on hand, the user or installer may build and install the attic stair apparatus 100.

Referring again to FIGS. 11-12 and 15-34. construction and installation of the attic stair assembly may include the following steps.

The following initial steps are followed prior to cutting or assembling any components. The instructions should be read and understood prior to commencing the assembly method. It is important to confirm the correct apparatus kit has been obtained.

First, the user or installer should identify the space that the stairs are to be installed. Most garage attic spaces have an opening to access the attic space or a set of fold downstairs. This is a good place to install the attic stair apparatus. If there is no opening or existing set of fold downstairs or it is preferred to install the apparatus elsewhere in the space, then the attic space should be carefully examined. The space must be at least 2" longer than the length of the stringers from the point that is below the highest point in the attic or where it is desired to have the stairs connect to the ceiling. This point of connection to the ceiling will be hereafter referred to as the Termination Point, which is the point where the user will step off the stairs into the attic. This termination point should have as much headroom as possible and preferably so the user may stand.

Almost all homes will accommodate the attic stair apparatus of the present invention, though the length of the apparatus and resulting opening in the ceiling is considerably longer than conventional attic stair openings. The attic stair apparatus of the present invention will fit almost all homes is because headroom space is needed only from the Termination Point going toward the End Point of about 5 feet with a head clearance of about 2 feet at the 5-foot mark and approaching the Termination Point.

As a user ascends the attic stair apparatus of the present invention, the user's head will be about 5 feet from the top of the stairs horizontally when the user's head begins to reach the ceiling. Thus, the user only needs higher headroom in the attic above about 5 feet from the Termination Point.

It is important to carefully review and follow the information herein including the figures, which dearly show that little space above the attic stair apparatus is needed for most of the stairs of the stair assembly.

Referring now to FIG. 11, Arrow 1 indicates the Termination point. This is the point where there is most headroom in the attic space and where the hinge for the stairs is set. Arrow 2 indicates approximately where a person's head rises above the ceiling into the attic. In this area the taper of the roof only has to have about 2 to 3 feet of headroom as the user ascends the stairs to have plenty of headroom to get into the attic.

Figure 15:
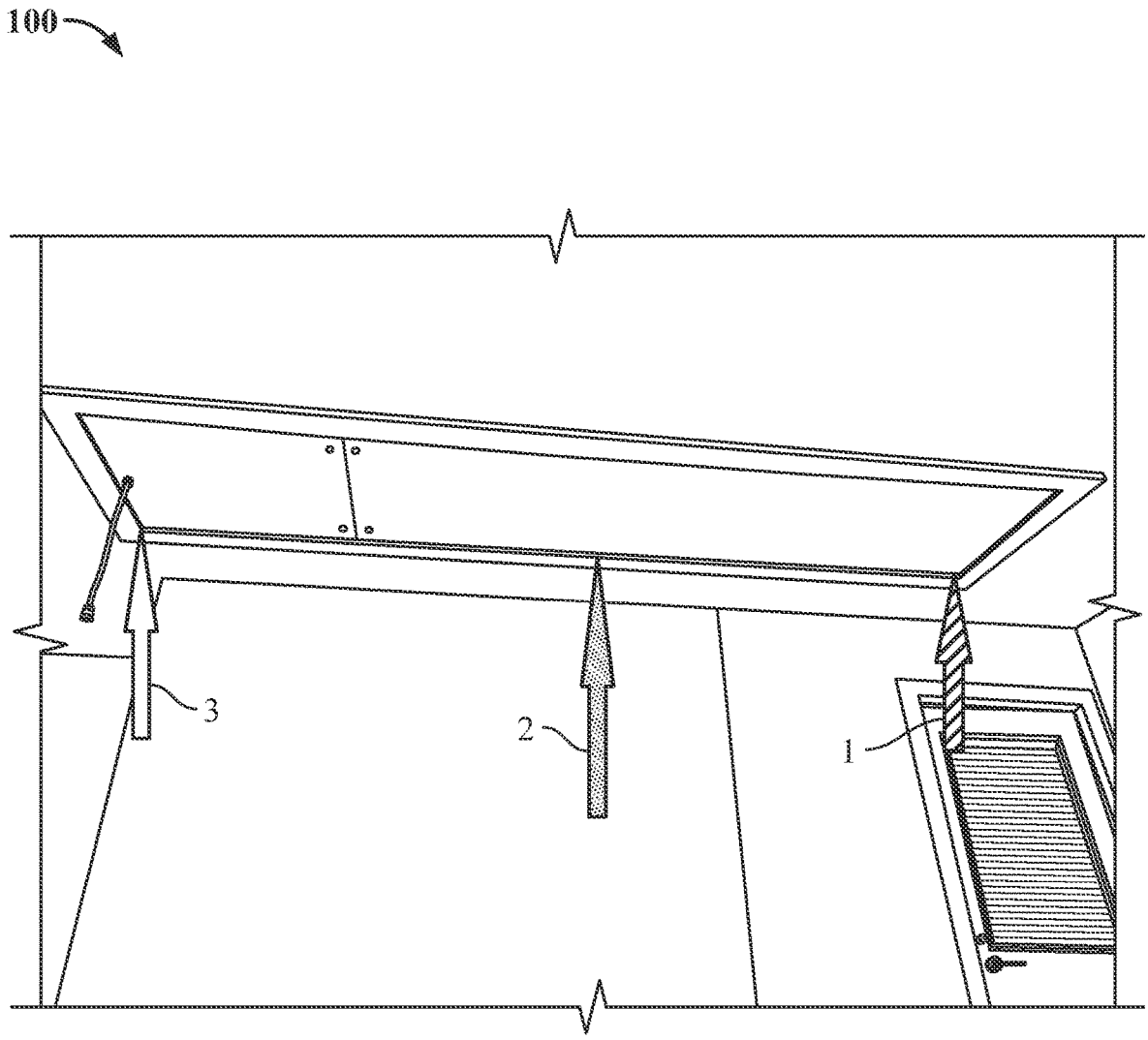
FIG. 15 presents a schematic view of an installation site.

As seen at FIG. 15, the Termination Point is shown at Arrow 1, the point where the user's head passes above the ceiling when the user ascends the stairs is indicated by Arrow 2, and the End Point is shown at Arrow 3. Significantly, the space between Arrow 2 and Arrow 3 does not need headroom to be more than 6" above the ceiling joists as no part of the user's body ever gets into this space in use of the stairs. As the space in the attic is assessed, the user should keep in mind that the user needs only enough room for the user's head to go above the stairs at the Arrow 2 point, and then the user needs only about 2 feet of space.as the user ascends the stairs since the taper for the roof rises, so the user ascends into the tallest part of the attic space at the termination point indicated by Arrow 1. Referring again to FIG. 12, a user is shown ascending stairs. As shown at FIG. 12, the location of the user's head is seen to be approximately 4 to 0.5 feet from the top of the stairs (the Termination Point). This demonstrates that one does not require a lot of headroom for the entire length of the stairs, only the last 4 to 5 feet.

Referring next to FIG. 16, the apparatus 100 must be installed between the ceiling joists (sometimes called the tie beam of the roof truss), which are designated by Arrow 4 and Arrow 5. It is an important note that a user or installer must NOT cut the ceiling joists or the beams out to install the attic stair apparatus. If it is desired to install the attic stair apparatus across the direction the joists are going, the user must consult a structural engineer to evaluate the building and design a structural support to accommodate the revisions necessary. The attic stair apparatus is meant to be installed to nm parallel with the ceiling joists without cutting any joists. Once the Termination Point is identified, the user then measures along the ceiling joist to the End Point for the stairs. The stair length will depend upon the ceiling height above the floor. An 8' ceiling has stair stringers that are 10'5" long. The stairs are installed between the ceiling joists.

Next, once the Termination Point has been identified, the user measures from the Termination Point along the ceiling parallel with the joists in the direction the user wants to have the stairs pull down. This will provide the End Point of the stairs. If the user has an 8' set of stairs, then the user measures back 10'6". If the user has a 9' set of stairs the user measures back 11'6" If the user has a 10' set of stairs, the user measures back 12' 6". This is the length of the rough opening for the stair assembly and will be as wide as the distance between the joists. NOTE: Most joists are set approximately 24" on center leaving a distance between joists of approximately 22". It is vital that the user determines the distance between joists prior to cutting anything or starting to build the stairs. Determine the inside distance between the joists, then cut the steps 4.5" shorter. If the user makes the steps any larger the stairs will not fit.

Now that the user has determined the rough opening for the stairs in the ceiling (distance between the Termination Point and End Point), the user then looks at the top of the ceiling in the attic space. The user removes any insulation between the joists where the stairs will go, also making sure there are no power cords, television cables, gas lines, telephone lines, etc. lying directly on the sheetrock or stapled to either side of the joists where the stairs will be located if any of these items are present, they should be moved so they are suspended at least 6" above the stairs or off to the side of the joists. It is noted that the area from the Termination Point back 5' toward the End Point must be totally clear all the way to the roof line. This is to allow head room for someone walking up the stairs. From 5' back from the Termination Point to the End Point, at least 6" of clearance will be needed above the joists to the stairs to clear.

Figure 17:
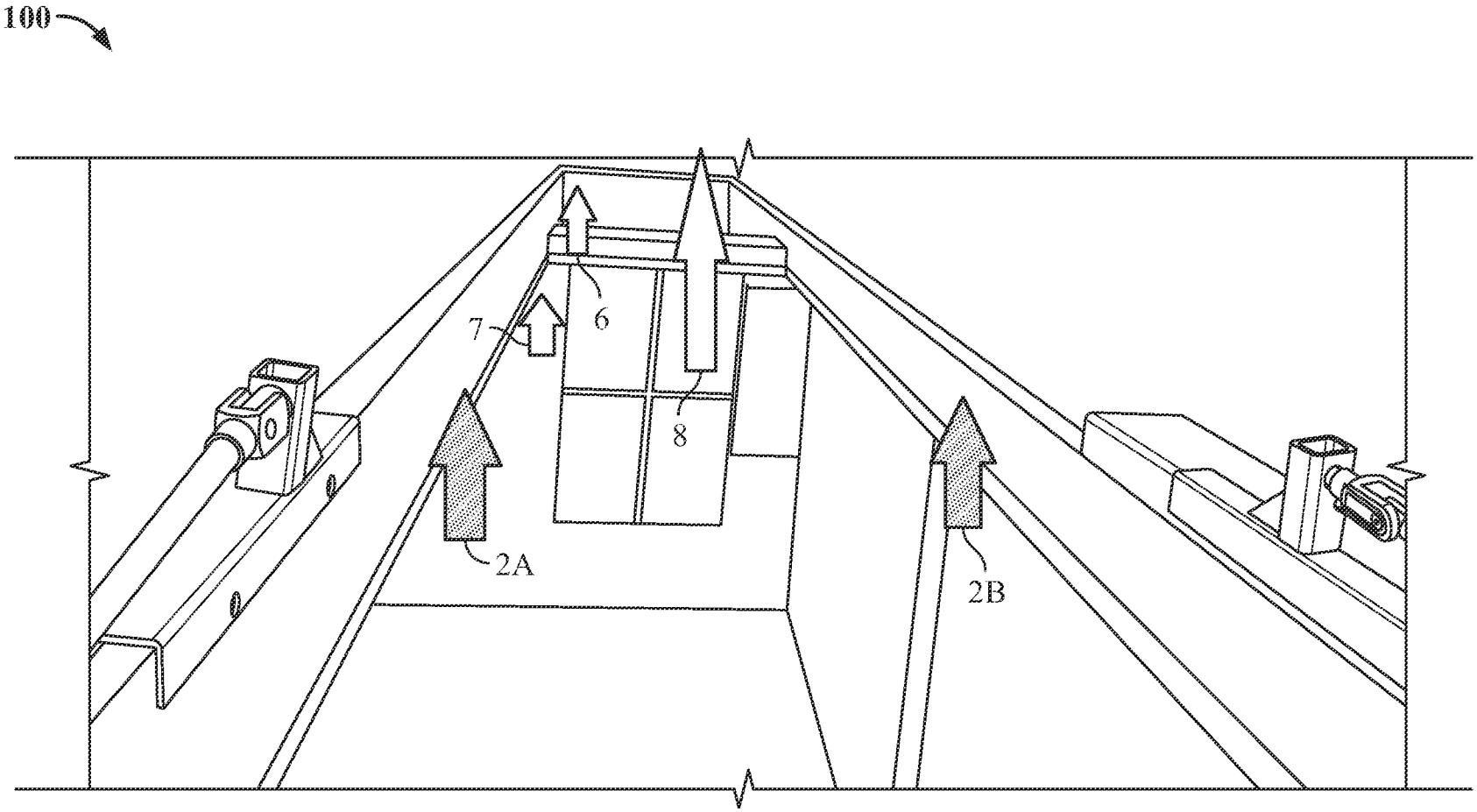
FIG. 17 presents a schematic view of a retractable attic stair apparatus as in FIG. 11.

Referring now to FIG. 17, Arrows 2A and 2B indicate the distance where the head of a person ascending the attic stair apparatus will rise up into the attic approximately 4 to 5 feet from the Termination Point at the top of the stairs. Arrow 6, Arrow 7, and Arrow 8 illustrate items which are located over the stairs and have very low clearance above the joists—it is seen that the apparatus and its components do not interfere with these items, and similarly, these items do not interfere with the stairs or use of the stairs to access the attic.

It is important that the user does not cut or commence any assembly until after the steps mentioned hereinabove have been completed and it is determined that the stairs will fit in the selected space in the user's home. Failure to do this could result in damage to the home, and an attic stair apparatus that will not fit in the home.

The kit 200 is examined to ensure all of the following parts are present. In some embodiments, the kit 200 may include the following components.

2—large stair pivots
2—small stair pivots
1—small joist plate with 1" hole—4.5"×5.5"
4—large stringer plates—5.5"×5.5"
2—lengths of 112" pipe 13" long—hinge pieces
2—lengths of W' pipe 60" long, threaded on both ends—railing pieces
2—lengths of 11S" pipe 4.5" long, threaded on one end with a welded plate on the other end railing risers
2½" black pipe elbows—railing 90 s
1—black pipe couplers for hinge pieces
2—gas shocks
4—gas shock ends—with ⅜" bolt hole
2 gas shock ends with fork and snap in ⅜" pin
36 SNUG fasteners
8⅜"×3.5" lag bolts
2⅜"×1.5" machine bolts
2⅜"×4" all thread (or all thread)
2—13/16" shaft collars
4—3" sheetrock screws
8—2"×⅜" machine bolts
8⅜" machine nuts
4⅜"×4" lag bolts
12—5/16"×2.5" lag bolts
8—5/16 flat washers Between forty-four (44)—fifty-two (52)—Power Pro 47877 Lag Screws, 5/16"×4", Star Drive Construction Lag Screws, Rust Resistant, Ceramic Coated Bronze. The 8' stair kit will include forty-four (44) screws. The 9' stair kit will include forty-eight (48) screws. The 10' stair kit will include fifty-two (52) screws.

After close inspection of the kit 200, the user or installer will mark out the length of the stair opening on the ceiling with the Termination Point and End Point. Then the user or installer will cut the sheetrock out between the joists and between the Termination Point and End Point. This should leave an opening to the attic space that is the width of the joists and the length of the stairs plus 1".

After the opening is prepared and ready, the stair assembly may be constructed according to the following instructions.

If a backing is used, it may be necessary to cut the backing in half-length wise to provide two pieces having dimensions of 8'×2'. For best results, this should be done on a table saw or a radial arm saw.

Cut two of the 2×6 boards to the length for the stairs. The board length for an 8' ceiling—10' 5"; the board length for a 9' ceiling—11'0"; and the board length for a 10' ceiling—11 'T' These boards will be the Stringers. It is recommended that the boards selected for the stringers be straight both ways and as free of knots as possible.

Make the stair steps by cutting a 2×6" board so the stairs are 4.5" shorter than the distance between the ceiling joists at the Termination Point. Cut 11 steps for an 8' ceiling, 12 steps for a 9' ceiling; and 13 steps for a 10' ceiling, making sure the cuts for these stair steps are square on the ends thereof.

Using a template provided marked "bottom stringer template", the template is placed on one end of the each of the stringers and the angle shown on the template is cut This is repeated for both stringers. The stringers will now have an up and down position as shown at Picture #6 which shows the up position on the stringers.

Figure 18:
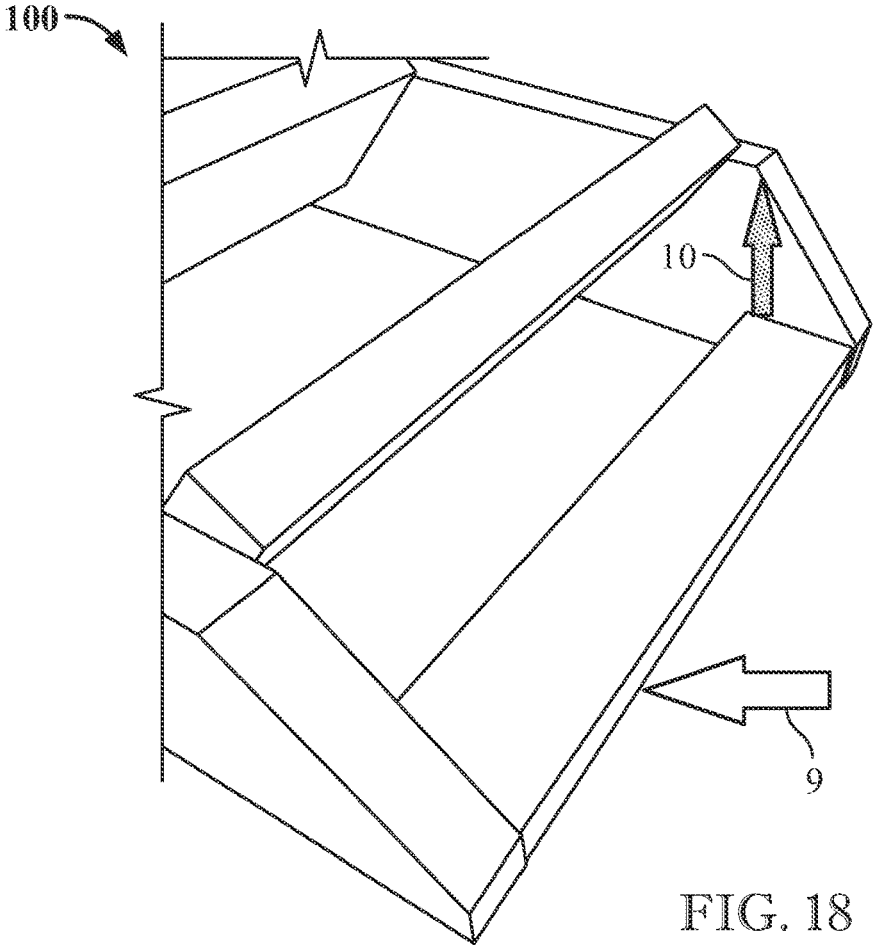

Referring now to FIG. 18, Arrow 9 points to the very bottom of the stairs where the stairs will touch the floor when installed. Arrow 10 indicates the proper orientation of the stringers and shows the stringer UP position. It is important to note that the user or installer should not orient the stair assembly in a manner which results in a configuration wherein the 45-degree angle is down.

Next, using a template provided marked "Step Predrill Template" provided in a kit 200, the user or installer will place the template on the stringer at the bottom of the stairs, mark, and then drill two (2)—3/16" holes in the stringers per step on one side of each stringer. It is noted the template will enable the user or installer to drill two step holes in succession. Then, the user or installer may slide the template up until the bottom set of holes line up with the top set of holes, and then mark and drill the next set of holes. The user or installer may continue to follow this process for the entire stringer. Then the user or installer may repeat the process for the second stringer, being careful to get the orientation of the stringer UP. Once the holes are drilled, the user or installer may use the plurality of SNUG fasteners to fasten the stairs to the stringers. The user or installer should be sure to center the stairs on the holes by using the templates to locate the stairs on the correct angle and centered over the holes.

Figure 19:
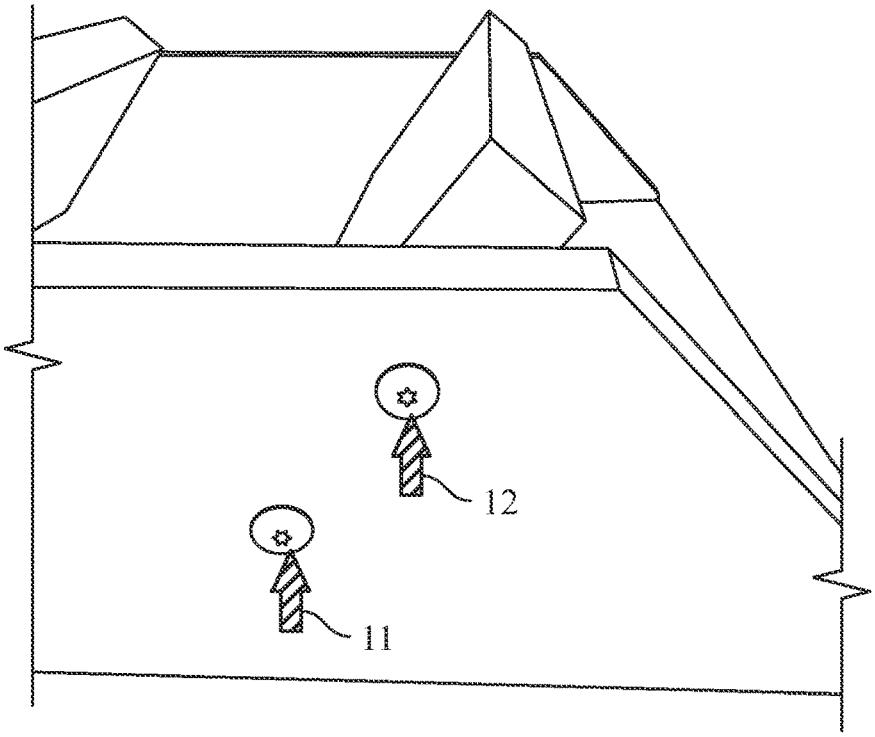

Referring next to FIG. 19, Arrow 11 and arrow 12 show the SNUG fasteners in place. The template drilling description hereinabove, has been followed to drill and provide the holes which receive the SNUG fasteners to attach the stair steps.

Figure 6:
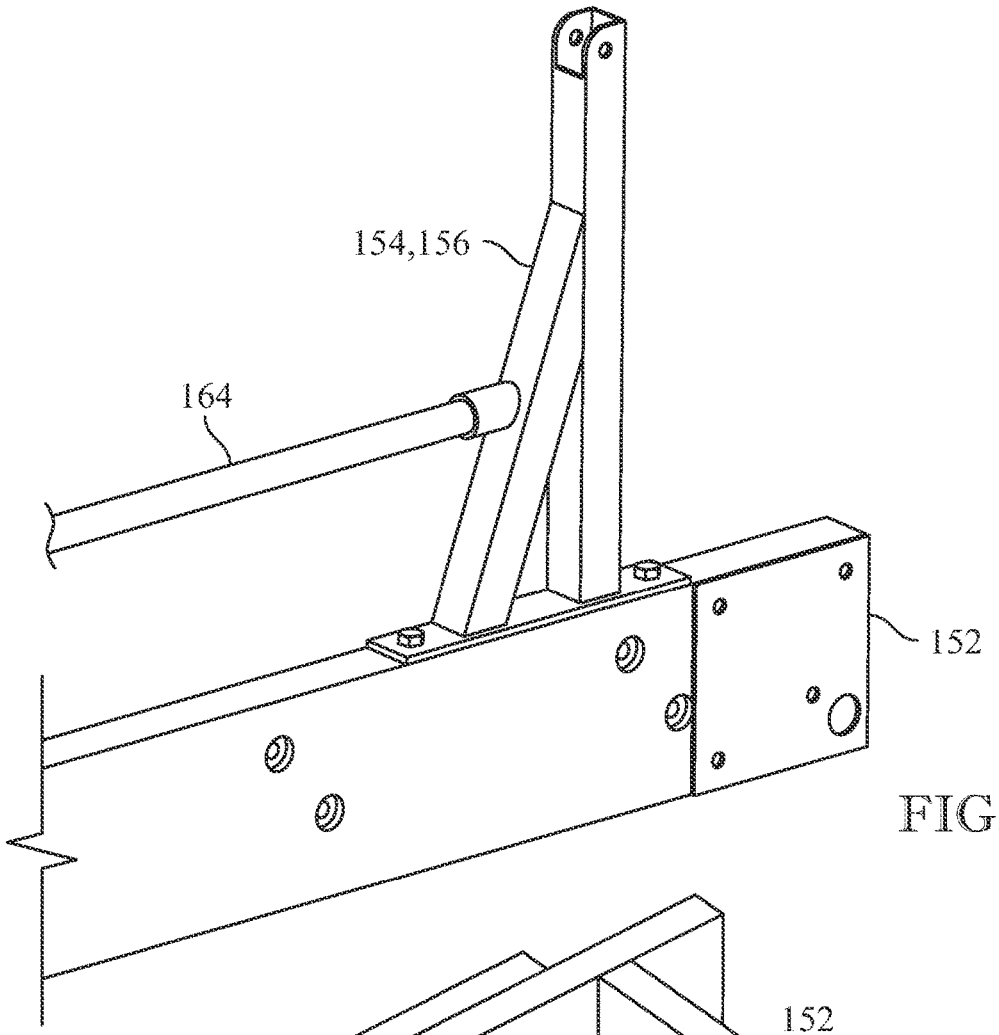
FIG. 6 presents a perspective view of a stringer plate assembly of the attic stair apparatus in accordance with the present invention.
Figure 7:
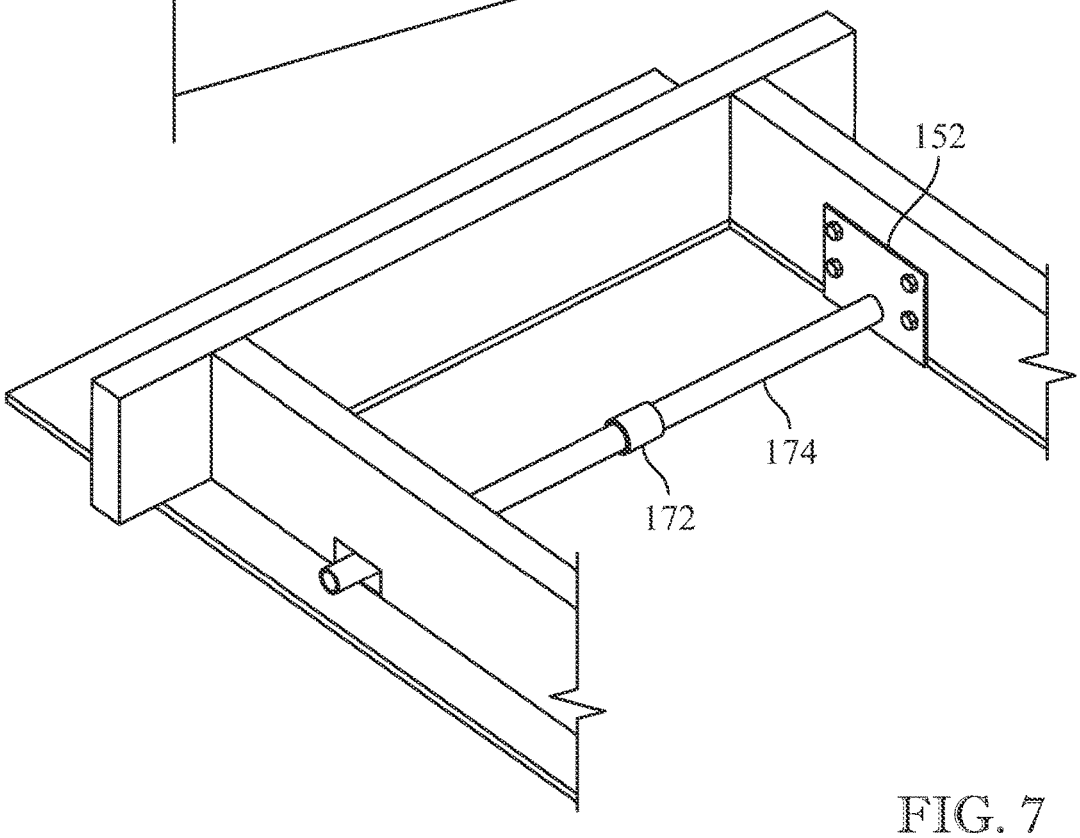
FIG. 7 presents a perspective view of a joist plate of the attic stair apparatus in accordance with the present invention.
Figure 8:
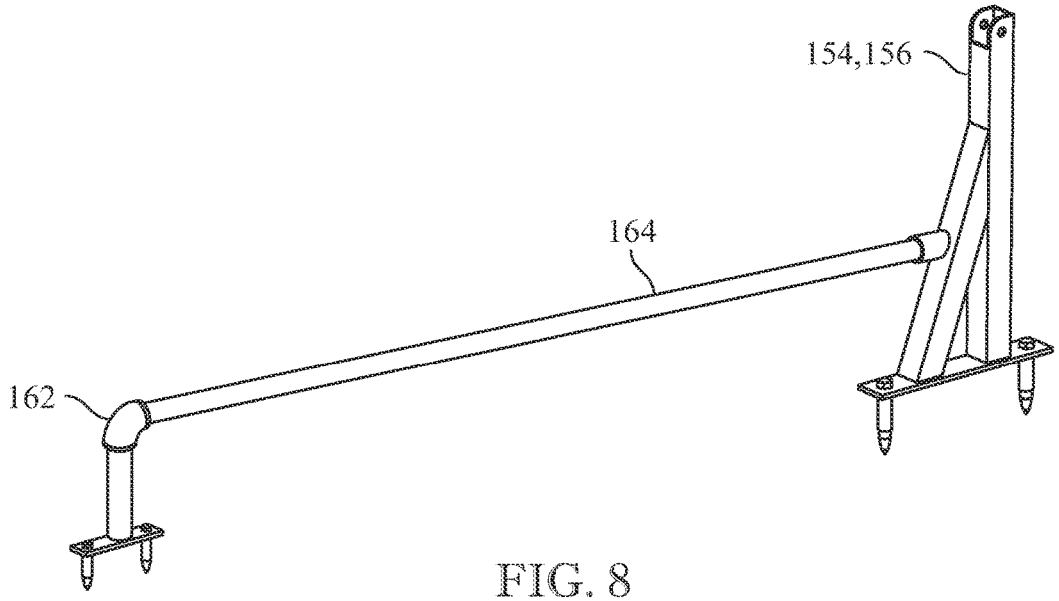
FIG. 8 presents a perspective view of a gas spring mount and a railing assembly of the attic stair apparatus in accordance with the present invention.

Next a user or installer will cut a 2×4 to the same length as the stair steps and fasten the cut 2×4 at the bottom of the stairs as shown in FIG. 6. The user or installer may use 3.5" sheetrock screws as indicated herein to fasten the 2×4, using two of the sheetrock screws on each side.

Next, at the top of the stairs, the user or installer will place one of the 5.5"×5.5" stringer hinge plates on the side of the stringer. The stringer hinge plate will be placed so the large hole is at the bottom of the stringer at the very end of the stringer. It is noted that the stringer hinge plate hole includes a first 2" side and a second 1//' side. The user or installer should make sure the first W' side of the hole is down. The user or installer will then drill four (4)—⅜" holes through the stringer. The user or installer will then place the matching 55"×5.5" plate on the other side of the stringer sandwiching the stringer between the stringer hinge plates.

Figure 21:
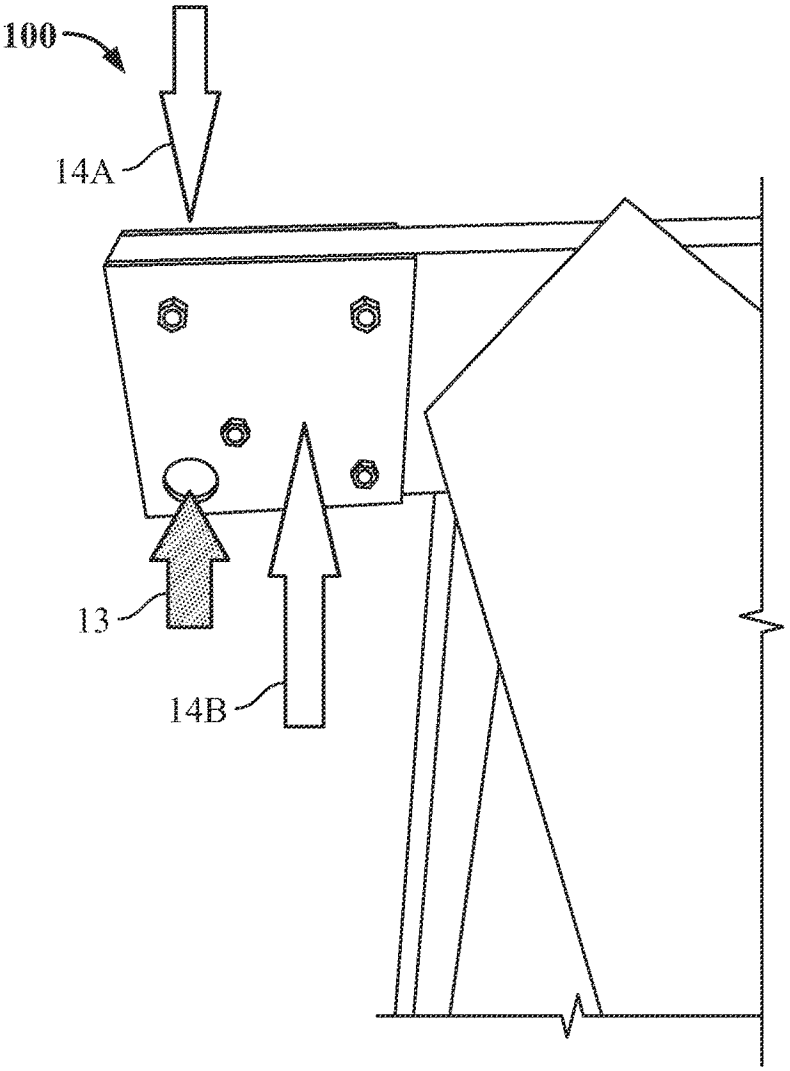
Figure 20:
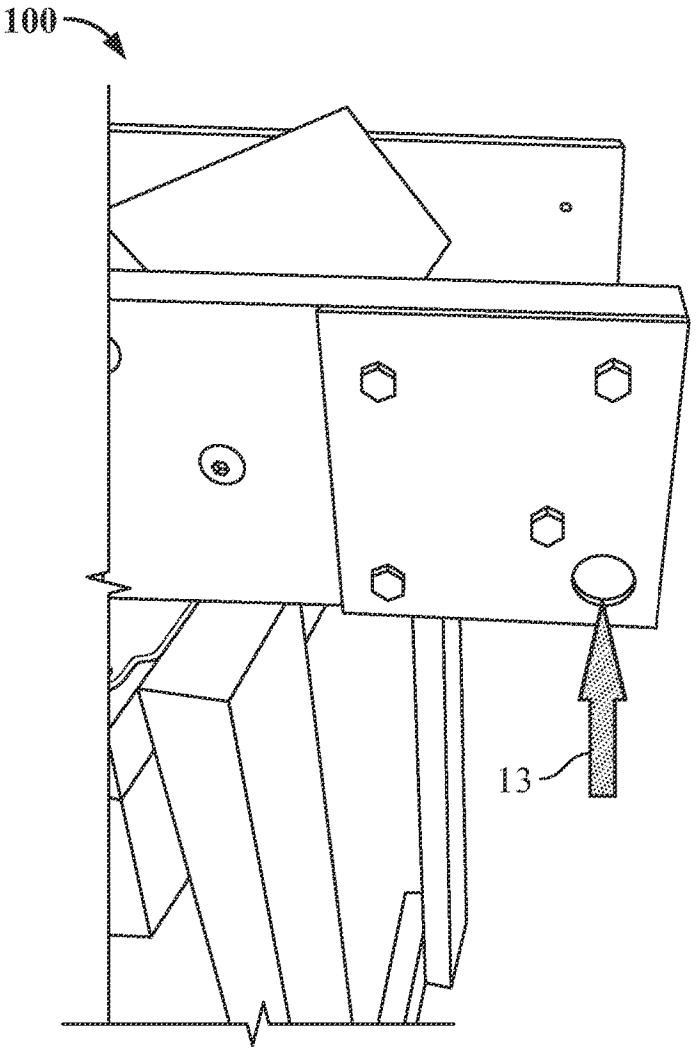
FIG. 20 presents a schematic view of installation of an attic stair apparatus as in FIG. 11.
Figure 22:
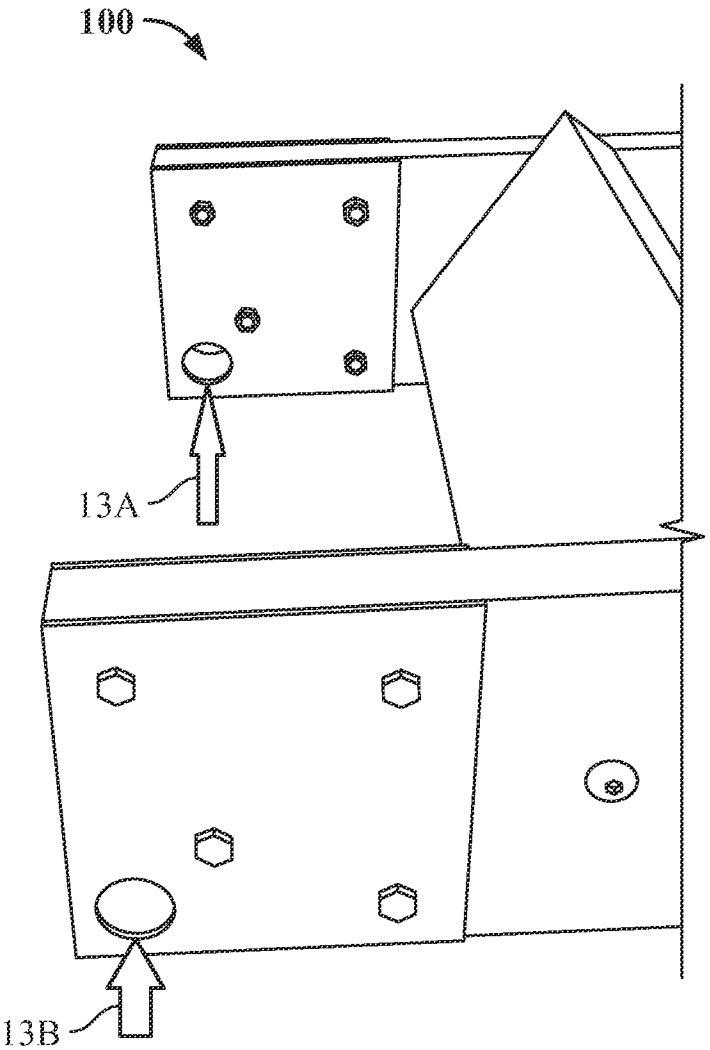
FIG. 22 presents a schematic view of the installation of an attic stair apparatus as in FIG. 11.

Referring now to FIGS. 20-22, the hole indicated by Arrow 13 must be located at a lower portion of the stringer. It is important to make sure the orientation is correct. Then the user or installer may install four (4) of the 5116"×1.5" machine screws through the holes and plates then put the nuts on them and tighten them up until the screw is flush with the end of the nut. The user or installer will then repeat this process for the other side of the stringer. With reference to FIG. 21, Arrows 14A and 14B indicate a plate on each side of each stringer sandwiching the stringer between them. Next, using a 1" hole saw, the user or installer may drill the wood out between the metal plates indicated at Arrow 13. With reference to FIG. 22, Arrows 13A and 13B show holes drilled in proper location through plates.

Figure 23:
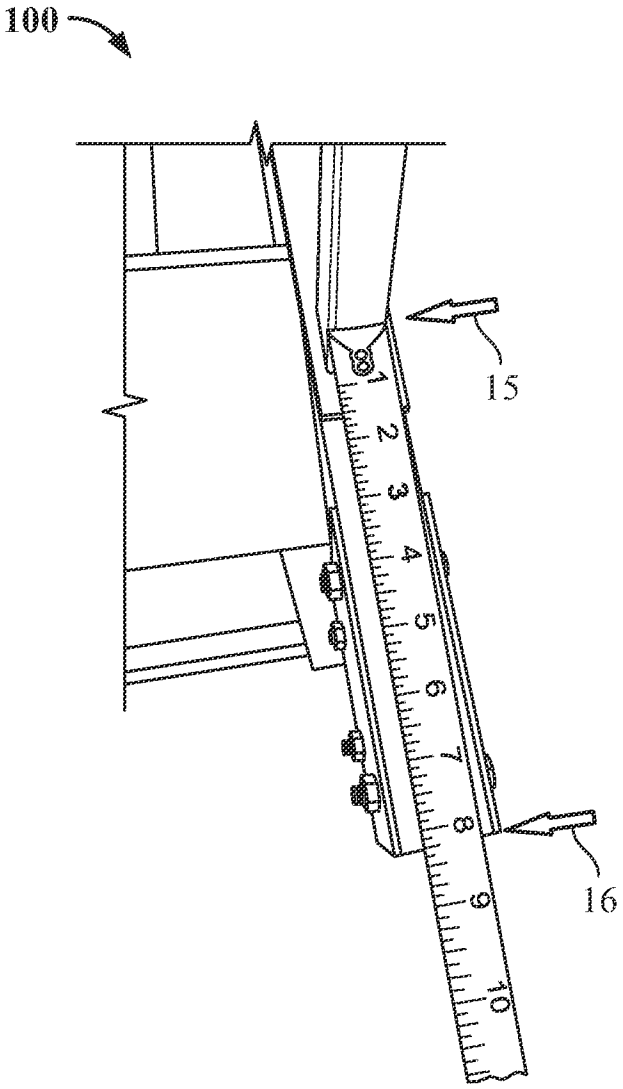
FIG. 23 presents a schematic view of the installation of an attic stair apparatus as in FIG. 11.

Referring now to FIG. 23, next, the user or installer should measure back 8¼" from the end of the stringer where the user or installer placed the steel plates and the large upright on the Large Stair Pivot bracket. It is important to note this measurement is critical for the stairs to open and dose properly. As indicated by Arrows 15 and 16, the user or installer should make sure the measurement is 8¼" to the front edge of the pivot upright, not to the front edge of the bracket where the bolt goes through the base of the bracket. The user or installer will locate one of the large.

Figure 24:
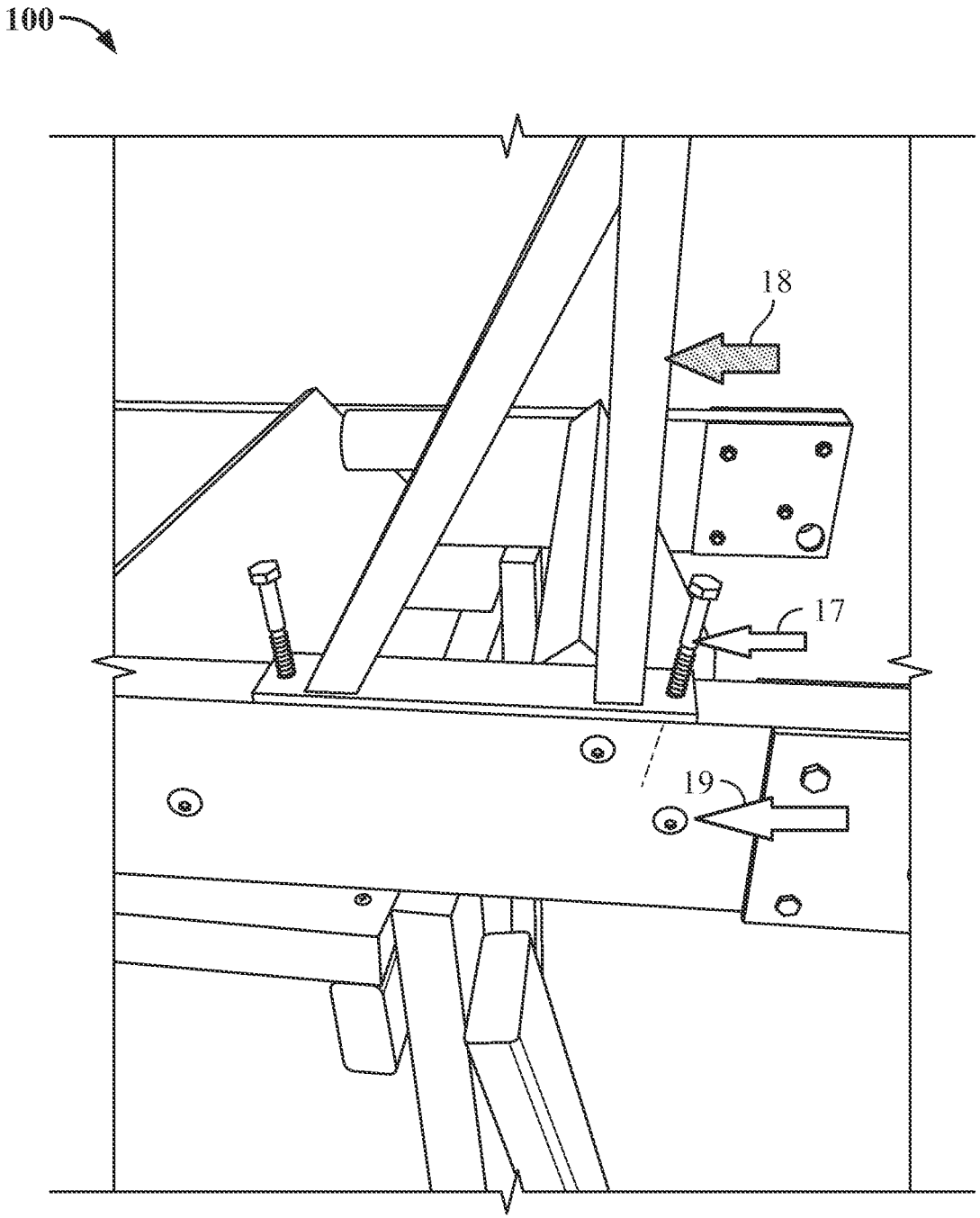
FIG. 24 presents a schematic view of the installation of an attic stair apparatus as in FIG. 11.

Referring now to FIG. 24, with reference to Arrow 17, it is seen that the ⅜×3S' bolts are installed in the stringer at an angle (not perpendicular) to ensure the bolt for the Large Stair Pivot does not hit the SNUG fastener holding the stair step. The Large Stair Pivot is indicated by Arrow 18. Notice the angle of the bolt indicated by Arrow 17, and the dashed line indicating the path of the bolt does not approach the position of the SNUG bolt for the stair step, indicated by Arrow 19.

Figure 25:
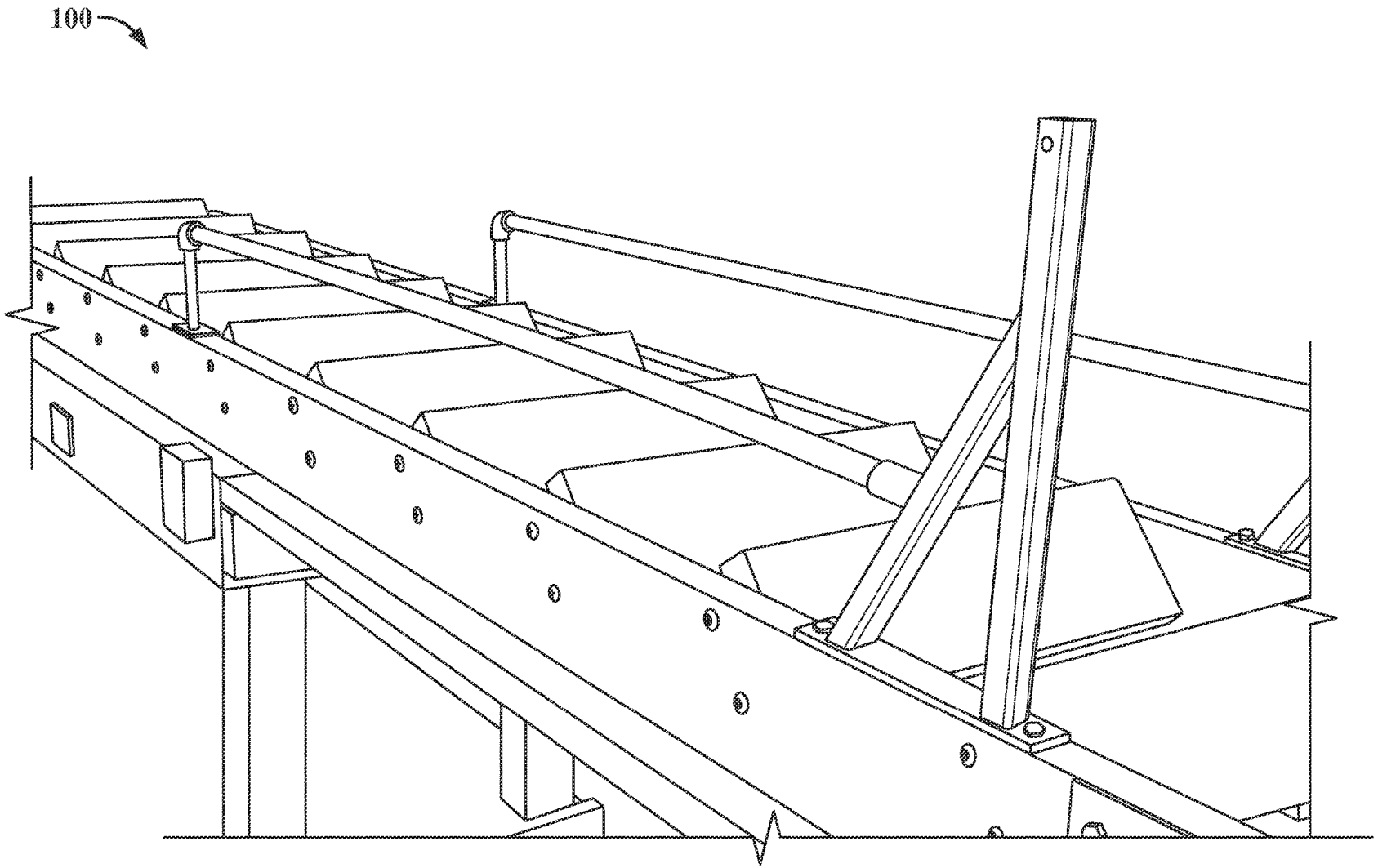
FIG. 25 presents a schematic view of the installation of an attic stair apparatus as in FIG. 11.

Next, with reference to FIG. 25, the user or installer will install the railings, using the 5⁄16×2" lag bolts to secure them to the stringer after screwing the handrail into the Large Stair Pivot. The improved stair apparatus is now ready to be installed at the ceiling hole.

Figure 26:
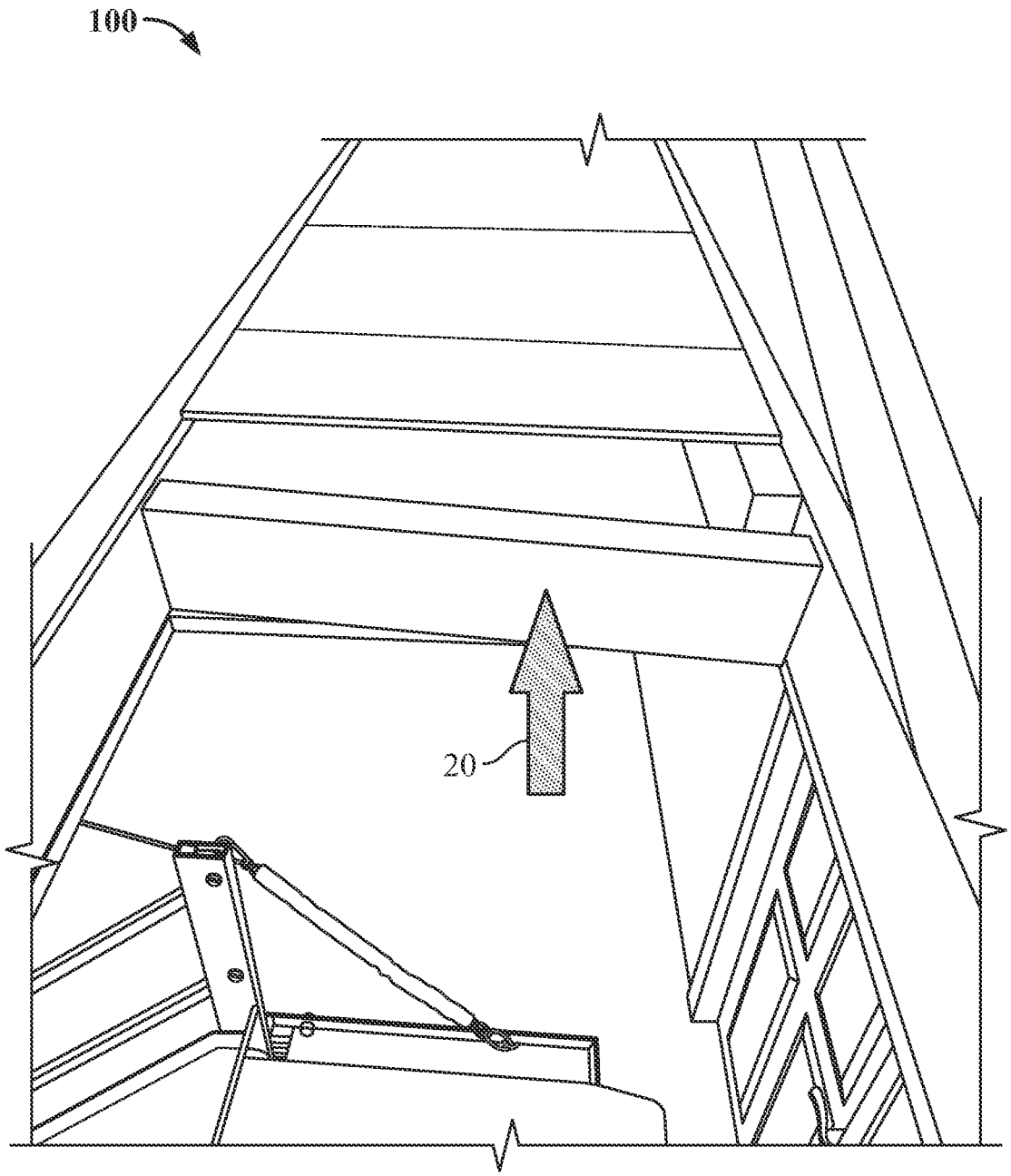
FIG. 26 presents a schematic view of the installation of an attic stair apparatus as in FIG. 11.
Figure 27:
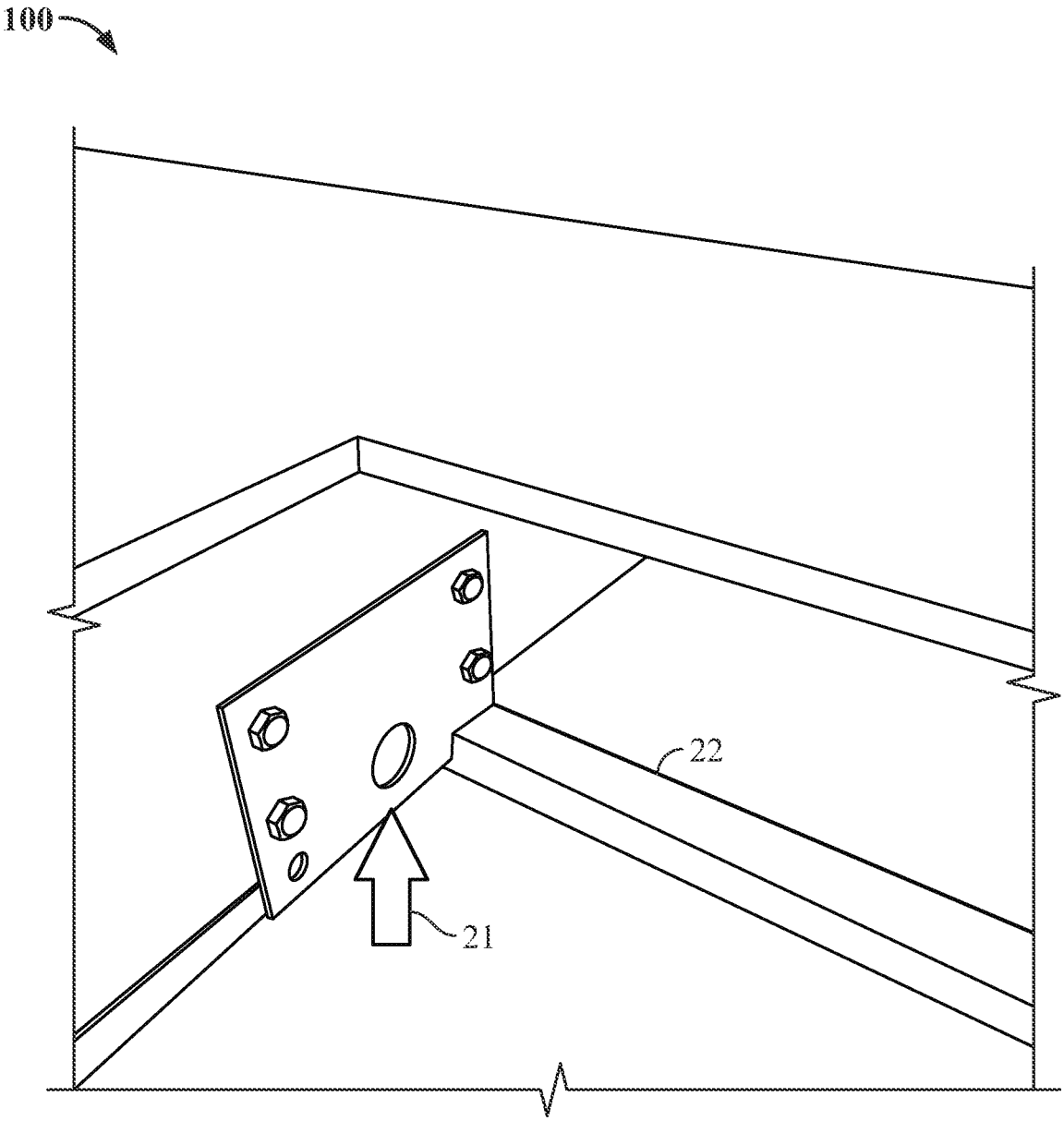
FIG. 27 presents a schematic view of the installation of an attic stair apparatus as in FIG. 12.
Figure 28:
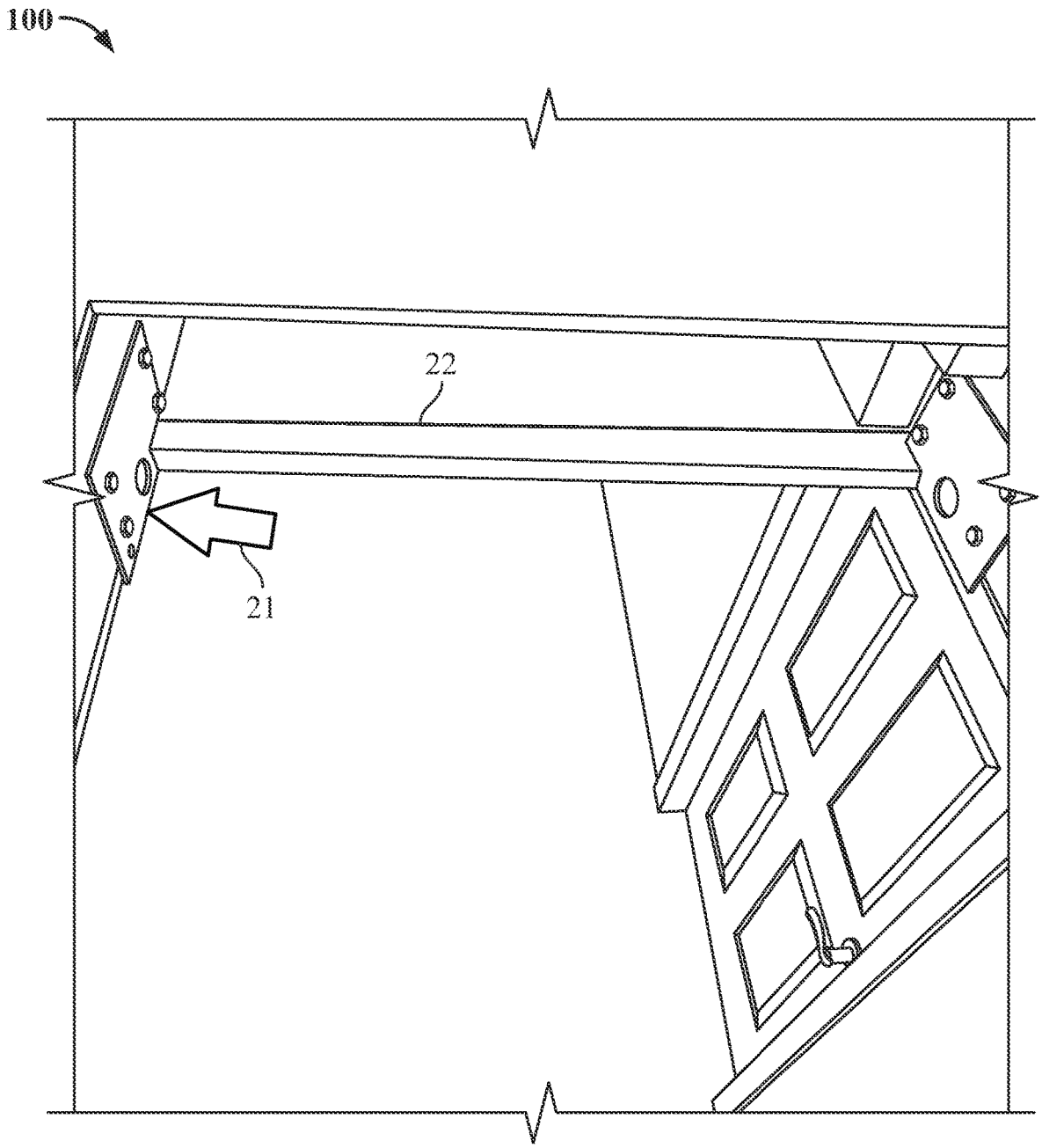
FIG. 28 presents a schematic view of the installation of an attic stair apparatus as in FIG. 12.

Referring now to FIGS. 26-28, the ceiling hole is prepared to receive the improved stair apparatus. If a set of existing fold down or other stairs are in place, these will need to be removed. Alternatively, if no ceiling hole to accommodate the attic stair apparatus exists, a hole needs to be made in the ceiling as described herein. At FIG. 26, a 2×6" board is shown between the stringers. This is the area where the old stairs were located. This area will be used as the Termination Point where the Stringer Side Plates will be bolted. The 2×6 that is present (as shown at Arrow 20) will interfere with the stairs and needs to be removed. If there is another board on the other side of where the old stairs were, the user or installer will also need to remove that board before installing the stair apparatus.

On the ceiling joists at the Termination Point, the user or installer will place a 4.5"×5.5" Stringer Side Plates on one side of the joist and place the adjustment plate opposite the fixed plate. As shown at FIG. 27, Arrow 21, it is important that the adjustable plate has the 1" hole centered in the adjacent plate with the 1" slotted hole. The user or installer should turn the adjusting screw to center the 1" hole. It is not important on which side the fixed plate and the adjusting plate go, the user or installer may install the two plates according to the instructions provided with the kit. The fixed plate and the adjusting plate must have the bottom of the plate flush with the bottom of the sheet rock on the ceiling. The plate with a round 1" hole should be installed first at an edge of the sheetrock where the Termination Point is located, with the 1" hole about 1" from the sheetrock at the Termination Point. As shown at FIG. 27, the Line 22 will be the edge of the sheetrock. The fixed plate and the adjusting plate must be installed and positioned directly across from each other at a 90-degree angle from the stringer. The adjustable plate must be directly across from the fixed plate with the round 1" hole and have the slot centered directly across from the 1" round hole. To do this, the user or installer should install one plate using the 5⁄16"×2" lag bolts and then use a framing square to get the center of the adjustable plate directly across from the center of the first one and using the 5⁄16"×2" lag bolts lag both plates to the joist. The user or installer should not tighten the four 5⁄16 lag bolts down on the adjustable plate: but should screw them in until they almost touch the slots on the hinge adjustment plate.

With continued reference to FIG. 27, the user or installer should cut the sheet rock at the Termination Point along the Line 22 from one side of the Stringer Side Plate (indicated by arrow 21) to the other side, as shown at FIG. 28. J\fake sure the Stringer Side Plates, indicated by arrow 21 at FIGS. 27-28, is flush with the bottom of the sheetrock.

Next, the user or installer will take a 1" hole saw and drill a hole into the wood on the stringers with the small joist plate with the 1" hole, drilling directly through the 1" hole in the plate. The user or installer will repeat this on the opposite side with the joist plate including a 1" slotted hole. The user or installer will drill out the wood at the ends of the 1" slot and then cut out the center of the wood so the hole in the wood is the same size and shape as the 1" slot in the joist plate. These holes must extend all the way through the joists and the stringers. The user or installer will need to make sure the holes are straight from one side to the other and one plate to the other.

The improved stair apparatus may now be installed in the ceiling. If not already in place, the user or installer may provide sheets of plywood and place the plywood sheets above the ceiling, around the hole for the stairs, and on the floor, so the user or installer will have a place to sit or stand while installing the stairs. The user or installer may place a strap or chain above the Termination Point attached to the roof trusses and locate the assembled stairs below.

Next, the user or installer may place a come along, a chain fall, or a hoist rated for at least 500 LBS (Lifting Device) on the strap or chain provided to connect hoist to roof trusses previously located. The user or installer should not attempt to lift the stairs up to the ceiling by hand, they are very heavy and personal injury could result in improper handling.

The user or installer will then place all of the remaining hardware in the attic space and then get up into the attic workspace.

The user or installer will attach the Lifting Device to the fifth (5th) stair from the top step by wrapping a strap around the center of the step.

The user or installer needs to have all the tools to drill holes and bolt the pieces collected for use. The user or installer will need two 19/16 wrenches and a socket or driver on the user's drill with a 9/16 socket and two 12" or similar pie wrenches. The user or installer will also need to provide a light source to illuminate the work site.

Figure 29:
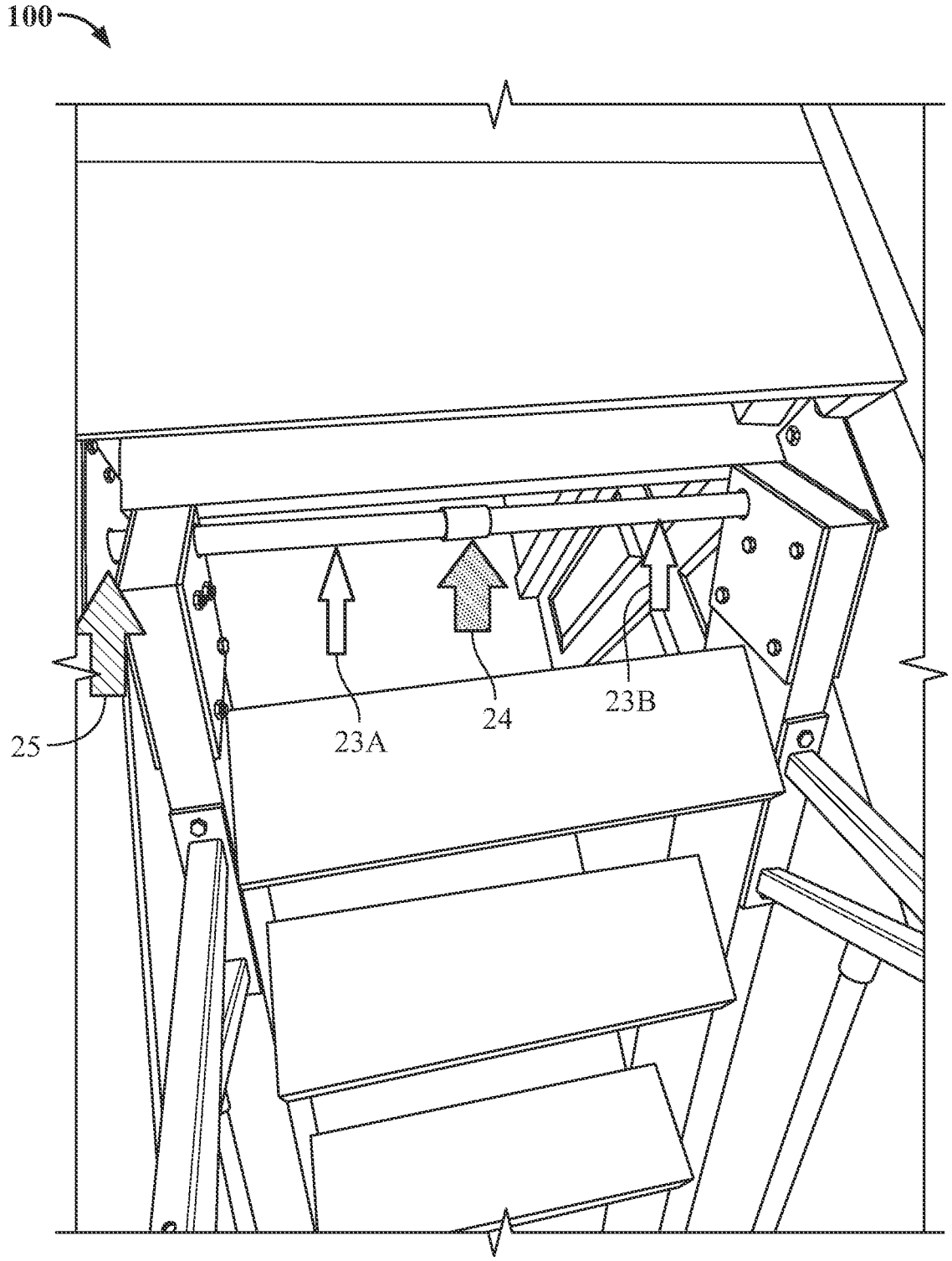
FIG. 29 presents a schematic view of the installation of an attic stair apparatus as in FIG. 11.

While in the attic workspace, the user or installer will raise the top end of the stairs up to the Termination Point using the Lifting Device. Referring now to FIG. 29, when the top end of the stairs is in place, the user or installer will take the two 13" long, ½" diameter hinge pipes (indicated by the Arrows 23A-B at FIG. 29) and will slide one through each stringer metal plate and then into each hole in the ceiling joists. Then the user or installer will take a 1; S" steel coupler (indicated by the Arrow 24 at FIG. 29) and screw the two pipes together tightly. This forms the hinge for the stairs. If these pipes are too short, that means that the user or installer has an unusually wide set of ceiling joists, and the user will need to obtain two ½" schedule 40 pipes threaded on one end that together are wider than the outer edges of the ceiling joists including both joists.

Next, the stairs should be centered in the hole. The user or installer should take one 13/16" shaft collar and place it between the joist and the stringer on the 2" pipe that makes up the hinge. The user or installer will make sure the pipe is centered in the holes between the two stringers and prevents the hinge pipe from working its way out of one side. The user or installer will then tighten the stringer collar screws tightly (as shown at Arrow 25 of FIG. 29).

Next, the user or installer will take a plumb bob and locate it on the ceiling joist at the End Point and drop it down to the bottom step of the stairs while the stairs are open. This will identify the exact position of where the stairs need to be to center them in the opening at the bottom of the stairs. The user or installer should measure the width of the distance between the joists and the full width of the stairs including the stringers. Then the user or installer should subtract the two and split that distance in half. This will determine the offset between the outer edge of the stringer at the bottom step and the plumb bob point. Once the stairs are set at this position and the stairs are centered between the stringers, then the user or installer will go to the top and tighten the bolts in the small joist plates on the side with the slots.

In a later step described hereinbelow, the user or installer will raise the steps. After the steps are raised, if the user or installer finds that the stairs are not centered between the stringers then the four (4) lag bolts should be loosened, and the adjustment bolt should be turned on the adjustable hinge to get the stairs centered. Once the stair assembly is centered, it is advised to screw a lag bolt into the stringer at both ends of the small joist plate with the four (4) slotted holes to ensure the stair assembly remains locked in place over time.

Figure 30:
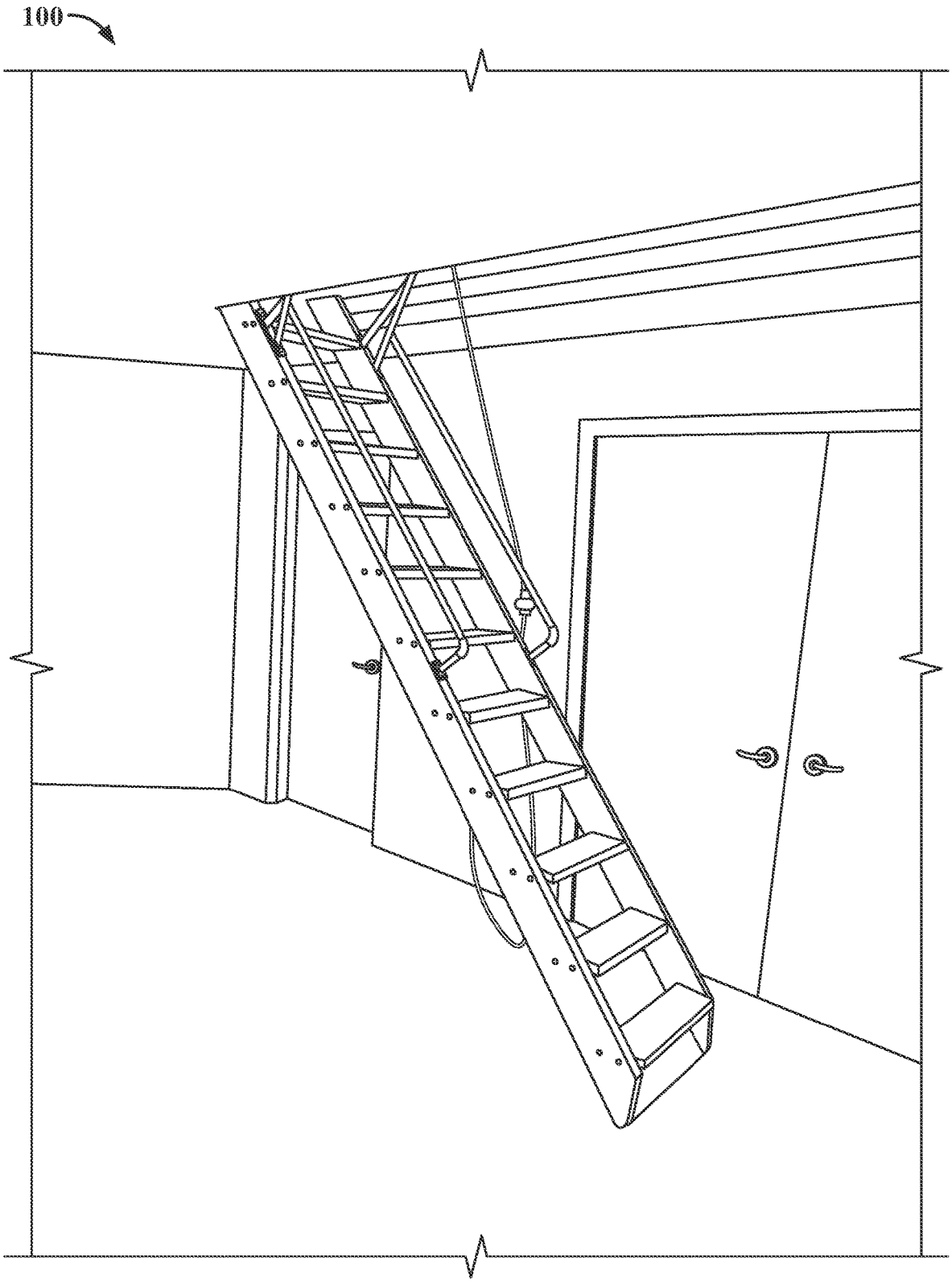
FIG. 30 presents a schematic view of the retractable attic stair apparatus in an installation site as in FIG. 11.

As shown at FIG. 30, the improved stair apparatus has now been installed to the point that the user or installer may use the stair assembly to get in and out of the attic.

Next, while the user or installer is in the attic space, the user or installer should raise the stairs up into the ceiling hole with the hoist. Again, as noted hereinabove, when the steps are raised, if the user finds that the stairs are not centered between the stringers the user will need to loosen the four (4) lag bolts and turn the adjustment bolt on the adjustable hinge to get the stairs centered. Once the stair assembly is centered, the user or installer may lock the stair assembly in place by screwing a lag bolt into the stringer at both ends of the small joist plate with the 4 slotted holes.

When the stairs are level with the ceiling joists, at the bottom end of the stairs, the user or installer will raise the stair assembly to a height at which the bottom stair stringer at the End Point is about 5" above the ceiling joists. This is necessary to preload the stairs so the gas shocks will press the stairs fully closed at the end point.

Next, the user or installer will take one of the gas shocks and place the large diameter end at the large pivot point near the top of the stairs and using the ⅜"×1.5" bolts along with the ⅜" nuts, a nonlimiting example of which is a Nylock nut (a nylon-insert lock nut, polymer-insert lock nut, or elastic stop nut). The user or installer will bolt the gas shock eye end to the large pivot point bracket. The user or installer will then screw the gas shock into the pivot point bracket.

The user or installer will next place one of the gas shock end forks on an opposite end of the gas shock.

Next, the user or installer will take the ⅜" all thread or all thread and place it through the small pivot bracket with two nuts on each side of the 1" bracket. The user or installer will thread the nuts tight up against the bracket. The user or installer will place the remaining ⅜" shock end on the ⅜" all thread or all thread and draw one of the nuts up tight against it. Next, the user or installer will move the other nut so both nuts and the pivot for the gas shock are tight against the bracket. It is important to note the user or installer should not allow any of all thread or all thread to be exposed between the small pivot bracket and the pivot for the gas shock. Failure of the ⅜" all thread or all thread will result if there is any gap. The user will use the nuts provided to draw the all thread or all thread tight to the bracket and tighten the fork connector for the gas shock rightly against the nuts on the all thread or all thread.

Figure 31:
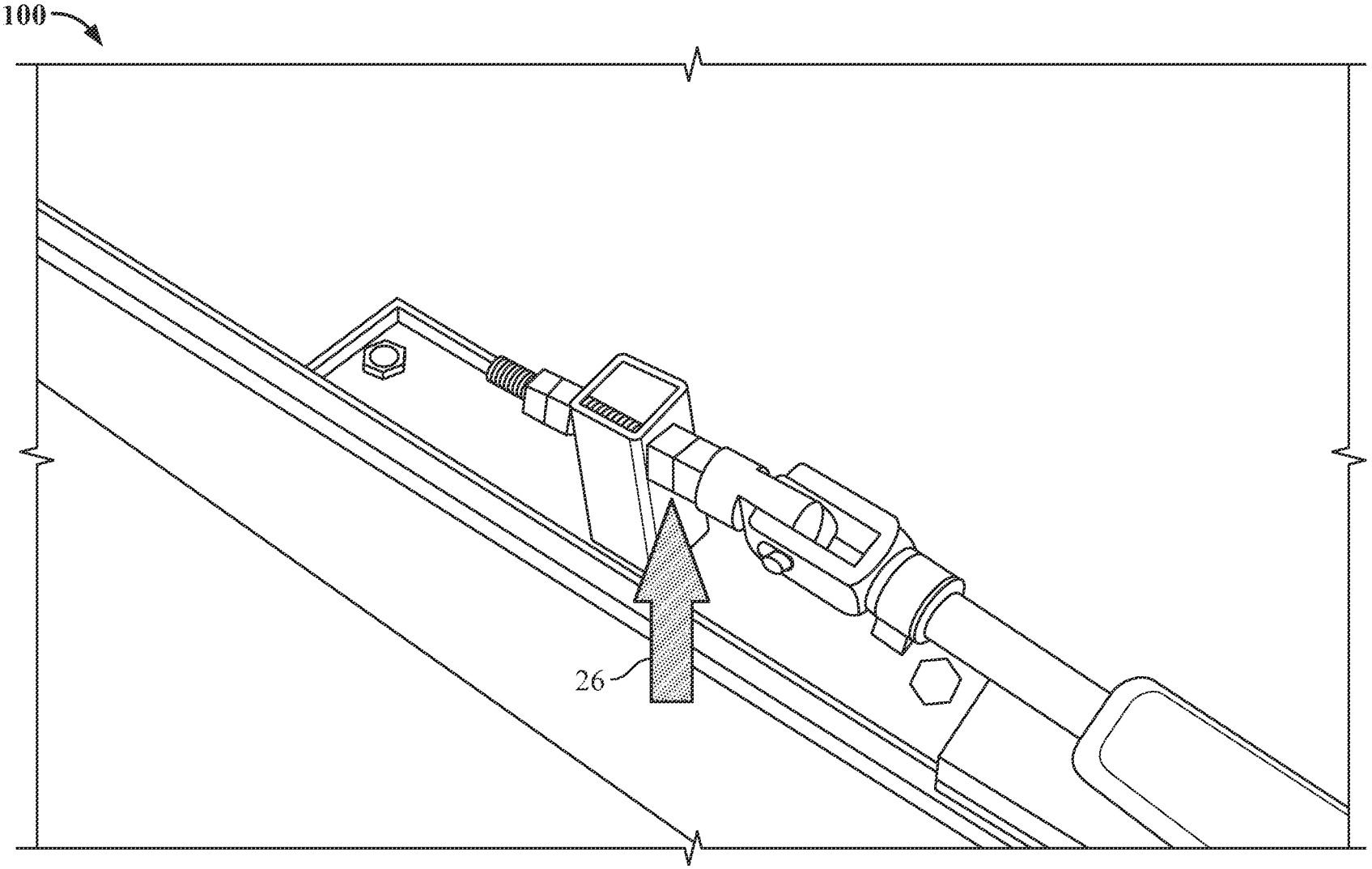
Figure 32:
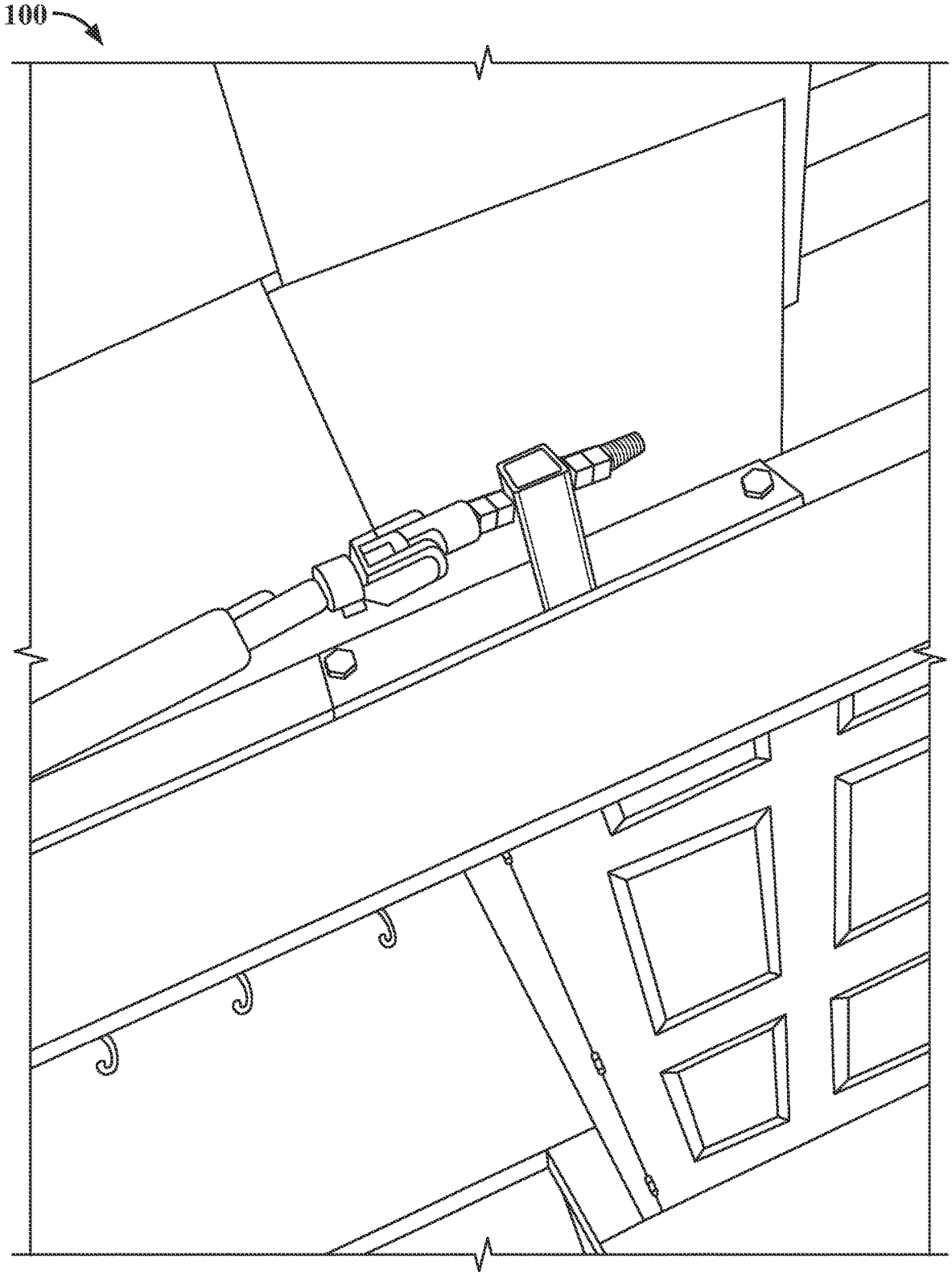
FIG. 32 presents a schematic view of the installation of an attic stair apparatus as in FIG. 11.

As seen at FIG. 31, the user or installer will next screw a gas shock onto the small bracket for the side of the stairs furthest from where the user is sitting and attach that gas shock to the large pivot point at the top of the stairs, as shown by the Arrow 26 in FIG. 31. Referring to FIG. 32, the user or installer will then screw a gas shock onto the small bracket for the side of the stairs closest to where the user is sitting and attach that gas shock to the large pivot point at the top of the stairs on that side.

Figure 33:
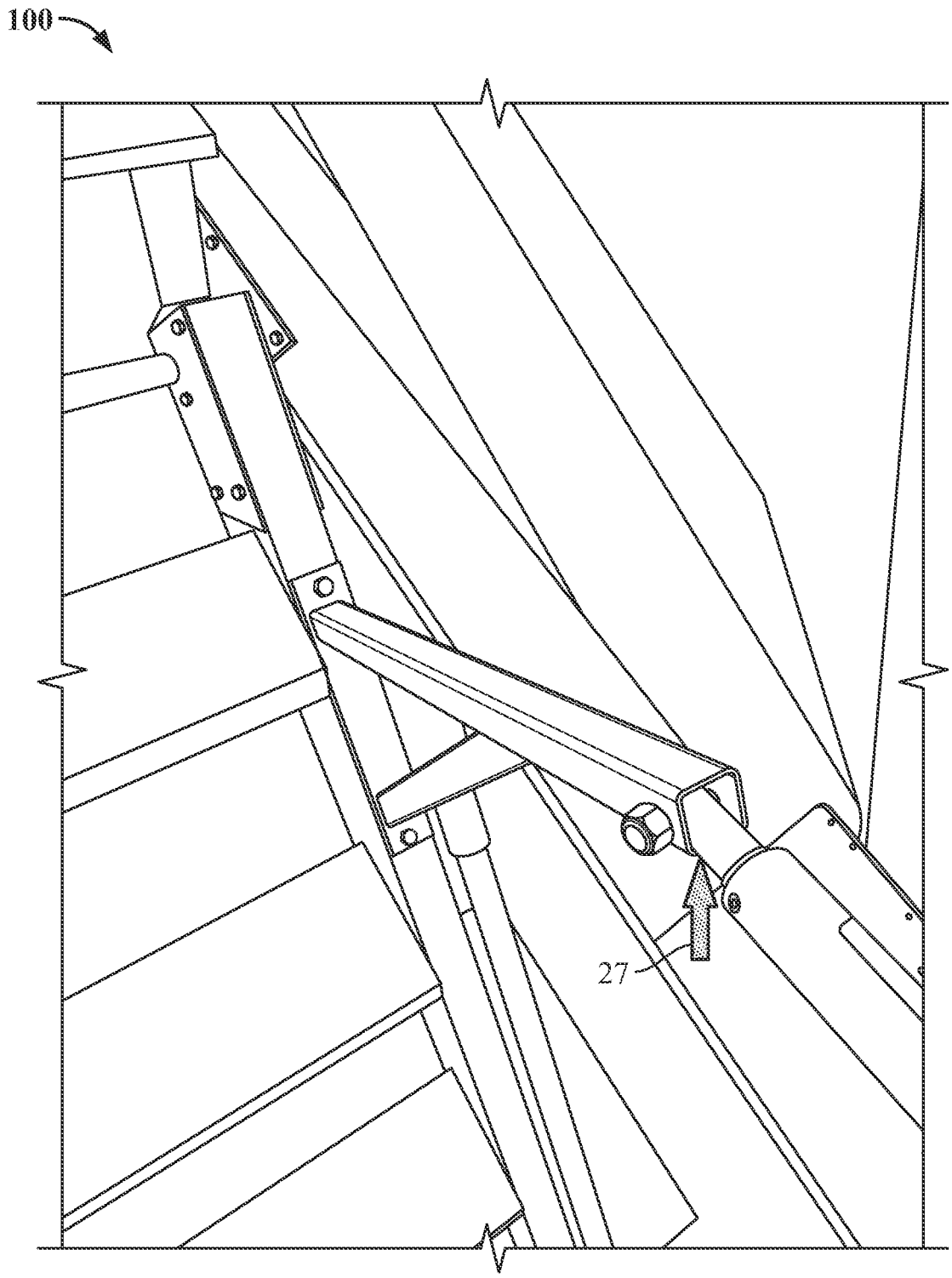
FIG. 33 presents a schematic view of the installation of an attic stair apparatus as in FIG. 11.

Referring now to FIG. 33, with the stairs raised up 5" above the joists at the bottom of the stairs, the user or installer will locate the entire shock assembly onto the top of the stringer farthest away from the user. The user or installer will drill 5/16" holes into the joist, and using the ⅜"×3.5" lag bolts, will then bolt the small pivot bracket to the joist. Next, the user or installer will locate the shock assembly onto the top of the stringer closest to the user. The user or installer should take care to avoid placing their legs or other parts of their body under the gas shock or railing of the stairs. Arrow 27 of FIG. 33 shows the gas spling assembly pivotally mounted in the large spring mount.

Now that both gas shocks have been installed, and the brackets are firmly bolted in place, the user or installer will slowly release the tension on the Lifting device. The stairs should settle downward so the Lifting Device will no longer be supporting the stairs. The stair assembly will now be supported by the gas shocks. The stair stringers should be an inch or two above the ceiling at the bottom of the stairs. This will ensure the stairs close fully when finished.

Next, a second person downstairs should very carefully and slowly pull the stairs down to the open position, while the user or installer is in the attic watching the lifting mechanism to ensure all components are working properly and not hitting or binding. If any component is hitting or binding, the user or installer should make appropriate adjustments to prevent such hitting or binding.

If the user or installer finds the gas shock will not fit because a truss bracing or support for the roof truss is in the way, the user or installer may need to attach another board onto the truss support that is interfering and then cut out the section of the interfering truss support to allow the gas shock to clear and move freely. If the user or installer is able to do this, the user or installer will make sure the hoard newly attached to the truss support provides at least as much support as the original truss support provided. The user or installer should consult with a structural engineer prior to proceeding with cutting out the support to ensure the structural integrity of the truss is not compromised.

At this point the stair apparatus should open all the way to the floor and remain open.

When pulled up, the stair apparatus should retract up to the ceiling and fully close above the level of the sheetrock.

Figure 34:
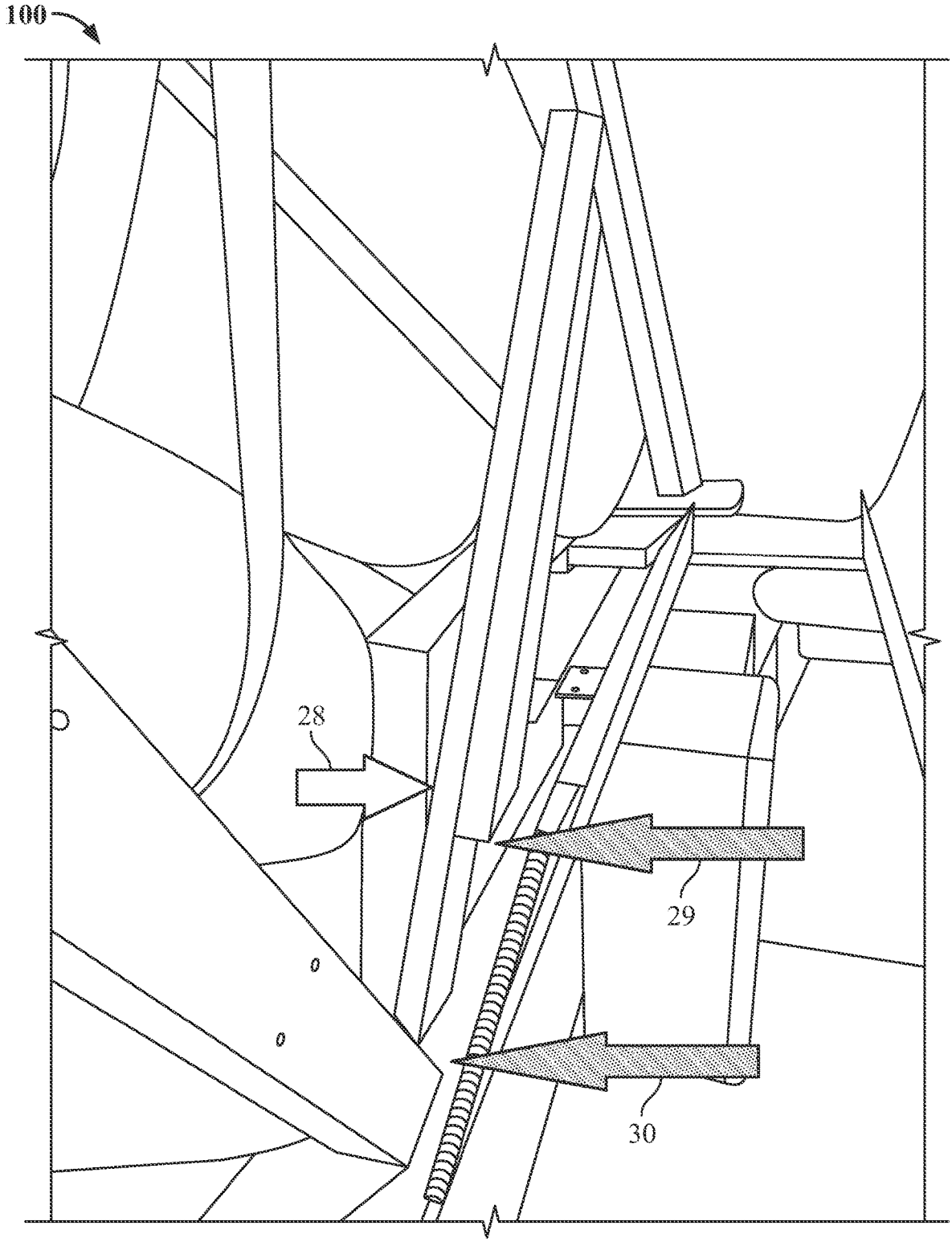
FIG. 34 presents a schematic view of the installation of an attic stair apparatus as in FIG. 11.

Referring now to FIG. 34, next, the user or installer should cut the backing or plywood exactly in half so there are two pieces that are 23 and 15/16" wide. This dimension considers the loss from the saw blade.

Next, the user or installer will cut out 1.5"×1.5" of the corners of one of the resulting 8' long pieces of backing. The 8' long piece of backing with the cut outs is placed at the top of the stair assembly, centered between the stringers and attached to the stringers.

This will leave approximately 1 5" plywood overhang on each side of the stringers. Next, the user or installer will attach the plywood using the SNUG Fasteners SNUG 108 #8×¾" Black Phillips Modified Truss Head Wood Screws, placing one screw every 12" along the length of the stringer holding the 8' piece of plywood. The plywood will now stick out on each side of the stringers overlapping onto the sheetrock when the stairs are fully retracted to the ceiling.

The user or installer will now cut the other piece of plywood to the appropriate length to be exactly at the end of the stringers and place that on the stair stringers the same way as the larger piece. Now when the stair apparatus is closed, the plywood edges beyond the stringers will flush up against the ceiling and the stair apparatus will dose properly.

Next, the user or installer will cut a 1"×⅜" piece of trim wood to the same width of the plywood and place it where the two pieces of plywood meet and screw it into place. The user or installer will now take the 1"×4" trim boards and trim around the stairs when the stair apparatus is closed, leaving about 112' gap between the plywood and trim pieces.

Next, the user or installer will drill a hole through the center of the stairs at the end point through the ¾" board and thread the nylon rope through the hole. The user or installer will tie a large knot in the rope above the ¾ and let the string hang down below the stairs. This provides the rope to grab hold of to pull the stairs down when opening the stair apparatus.

Arrows 28-30 show the wood trim now cut and installed.

The user or installer will look at the end point of the stairs and determine if it is flushing up to the ceiling the way the user or installer intend so that the assembly looks appropriate. If the bottom of the stairs (backing) is not recessing up evenly along the entire length of the stairs from the Termination Point to the End point, the user or installer will need to cut out the little bit of sheet rock between the trim piece and the joist above it, cutting all the way back to where the sheetrock meets the Large Pivot Bracket. Now the user or installer will close the stairs, which should now be permitted to retract into the recess above the trim pieces and look proper. If not, the user or installer will need to determine where the stair apparatus is binding, hitting or otherwise not tensioned properly and adjust.

If there is no binding or hitting and the stair gas shocks are not tensioned properly then the user will need to remove all the plywood from the bottom of the stairs to get the stair stringer to raise up above the ceiling stringers to properly tension the gas shocks. Then, the one or more of the steps of permitting the gas shocks to support the stairs, having a second person pull the stairs to an open position, adjusting any element that is hitting or binding, and adjusting the structure of the truss support with the advice and/or assistance of a structural engineer, should be repeated. If necessary, a new backing may need to be cut. The stair assembly should open all the way to the floor and stay open and when pulled up and should retract up to the ceiling closing fully above the level of the sheetrock.

The stair apparatus installation is now complete. As noted herein, the installed apparatus is seen at FIG. 11. The user may paint or stain the stair apparatus as desired.

In summary, the present invention may provide an improved attic stair apparatus for installation at an installation site in an attic or a garage.

The attic stair apparatus may include a stair assembly, a large left-hand spring mount, a large righthand spring mount, a rail assembly, a hinge assembly, and a plurality of hardware components.

The stair assembly has a stair assembly upper portion and a stair assembly lower position and may further include a left stringer; a right stringer; a plurality of stairsteps; and a backing.

The large left-hand spring mount may be fixedly connected to the left stringer at the upper portion of the stair assembly. The large righthand spring mount may be fixedly connected to the right stringer at the upper portion of the stair assembly.

The railing assembly may include a left railing and a right railing. The left railing has a left railing upper end and left railing lower end and may include a first left Sch. 40. Pipe end mount; a first left Sch. 40. Pipe—elbow; and a first left Sch. 40. Pipe—handrail. The left railing upper end may be fixedly connected to the large left-hand spring mount and the left railing lower end may be fixedly connected to the left stringer at the lower portion of the stair assembly.

The right railing has a right railing upper end and right railing lower end and may further include a second light Sch. 40. Pipe—end mount; a second right Sch. 40. Pipe—elbow; and a second right Sch. 40. Pipe—handrail. The right railing upper end may be fixedly connected to the large righthand spling mount and the right railing lower end may be fixedly connected to the right stringer at the lower portion of the stair assembly.

The hinge assembly may include a left hinge and a right hinge. The left hinge may be pivotally mounted to the large left-hand spring mount. The left hinge may include a left gas spring, a left male clevis, a left female clevis and a left fixed mount. The right hinge may be pivotally mounted to the large righthand spring mount. The right hinge may include a right gas spring, a right male clevis, a light female clevis and a light fixed mount.

The hinge assembly may further include a stationary adjustable joist plate and a sliding adjustable joist plate; a left stringer plate and a right stringer plate; a joist plate; a clamping two-piece shaft collar; a merchant coupler; a first left Sch. 40, ½" black pipe (hinge bar) mounted between the shaft collar and the merchant coupler; and a second right Sch 50, —S" black pipe (hinge bar) mounted between the merchant coupler and the joist plate.

The plurality of hardware components may be configured for assembly of the attic stair apparatus and installation of the stair apparatus in an attic or a garage. The plurality of hardware components may further include a plurality of ⅜" lags, 1.25 in; a plurality of ⅜" lags, 3 in; a plurality of ⅜" lags, 4 in; two ¾" bolts, Sin and two ¾" nuts; one ⅜" bolt, 3.5"; three ⅜" nuts; and two ⅜-16 threaded rods.

When the attic stair apparatus is installed at the installation site in an attic or a garage crawl space of a garage roof, the attic stair apparatus has a first retracted configuration wherein the attic stair apparatus is stored at the installation site, and a deployed configuration wherein the attic stair apparatus extends downwardly from the installation site for use of the attic stair apparatus by a user to ascend the attic stair apparatus for access to an attic, a garage crawl space or a garage roof.

The attic stair apparatus may be provided as a kit configured for installation in an installation site.

The present invention may provide a method for assembly of an attic stair apparatus as described herein. The method may include the steps of: identifying and measuring the installation site; clearing the installation site; providing a complete attic stair assembly kit; providing necessary tools; preparing a new or existing stair opening for installation of the attic stair apparatus; providing an assembled stair assembly; assembling the attic stair apparatus; and installing the attic stair apparatus in the opening at the installation site, including confirming the stair assembly is properly centered, and adjusting the position of the attic stair apparatus as needed.

Figure 5A:
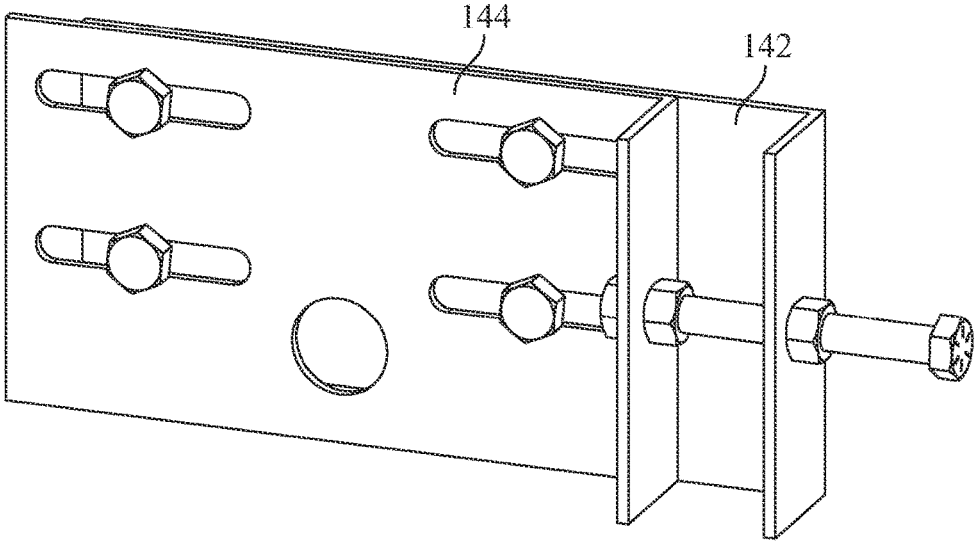
FIG. 5A presents a perspective view of an adjustable plate assembly of the attic stair apparatus in accordance with the present invention.
Figure 5B:
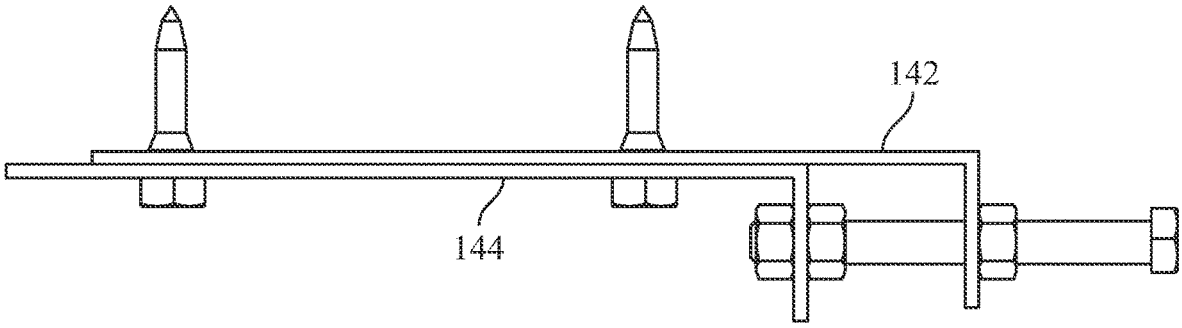
FIG. 5B presents a top view of an adjustable plate assembly of the attic stair apparatus in accordance with the present invention.
Figure 35A:
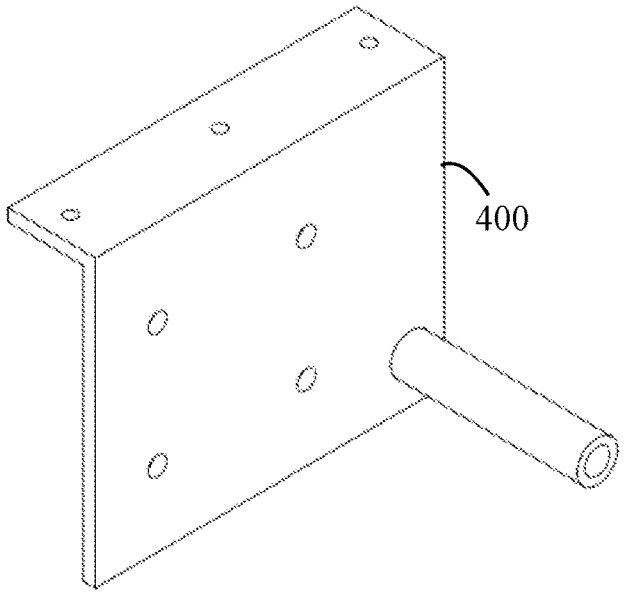
FIG. 35A presents a perspective view of the joist hinge plate.
Figure 35B:
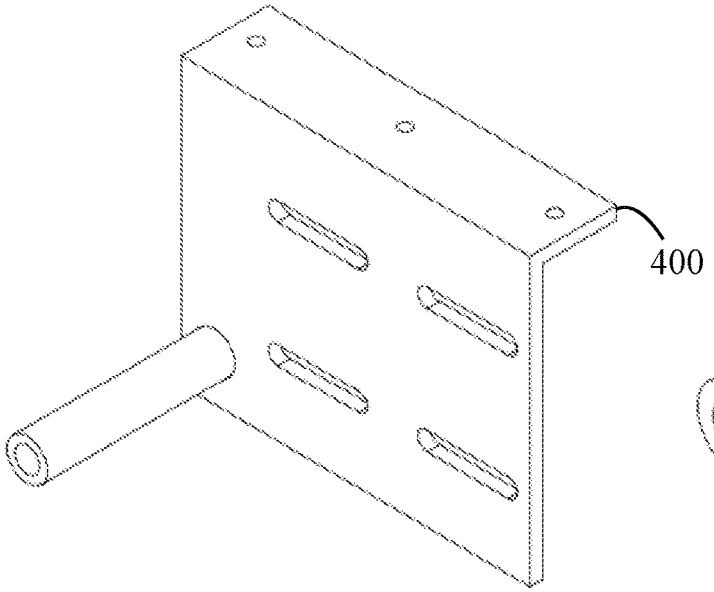
FIG. 35B presents a perspective view of the joist hinge plate.
Figure 36:
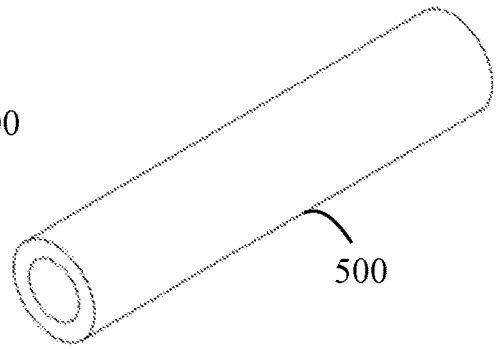
FIG. 36 presents a perspective view of the staircase hinge.

In some embodiments, FIGS. 35A-35B and FIG. 36 illustrate a joist hinge assembly 400 which may replace the bar hinge and side plate as illustrates hereinabove (see FIG. 3C, FIG. 7) and also replaces the bolt adjustment system (see FIGS. 5A and 5B). Hinge 500 shown in FIG. 36 replaces the elements 142, 144, 172, and 174 illustrated in FIG. 8 hereinabove. The embodiments illustrated in FIGS. 35A-35B and FIG. 36 eliminate the need for the gas spring assembly and hinge shown in FIG. 10.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an" and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, arc generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and arc herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. An attic stair apparatus, comprising:

a stair body having an upper end, and a lower end, said stair assembly including a left stringer, a right stringer, and a plurality of stairsteps positioned between the left stringer and the right stringer;

a hinge assembly that is positioned onto the upper end of the stair body, said hinge assembly being configured to pivotally secure the upper end of the stair assembly to a first building rafter located within a stair opening of a building;

an offset tensioner that is positioned adjacent to the hinge assembly, said tensioner including: a left spring mount that is positioned along an upper portion of the left springer, a left spring that extends outward from the left spring mount, and a left rafter mount that is connected onto the left spring opposite to the left spring mount;

a right spring mount that is positioned along an upper portion of the right springer, a right spring that extends outward from the right spring mount, and a right rafter mount that is connected onto the right spring opposite to the right spring mount; and a railing assembly that includes a left railing having a left railing upper end that is connected to the left spring mount, and a right railing having a right railing upper end that is connected to the right spring mount, wherein the stair body is configured to transition between an open position and a closed position.

2. The attic stair apparatus of claim 1, wherein the stair body includes a fixed shape and a fixed length in each of the open position and the closed position.

3. The attic stair apparatus of claim 2, wherein in the open position, the upper end of the stair body is positioned within the stair opening, and the lower end of the stair body is positioned against a floor of the building located opposite to the stair opening.

4. The attic stair apparatus of claim 3, wherein in the closed position, each of the upper end and the lower end of the stair body are positioned within the stair opening.

5. The attic stair apparatus of claim 1, wherein the left spring mount extends perpendicularly outward from the left stringer, and the left spring is connected along a distal end of the left spring mount.

6. The attic stair apparatus of claim 5, wherein the left rafter mount is configured to engage a second building rafter located within the stair opening at a location adjacent to the left stringer.

7. The attic stair apparatus of claim 6, wherein the left rafter mount is configured to engage the second rafter at a distance from the stair body upper end equaling ⅓ a length of the stair body.

8. The attic stair apparatus of claim 7, wherein the right spring mount extends perpendicularly outward from the right stringer, and the right spring is connected along a distal end of the right spring mount.

9. The attic stair apparatus of claim 8, wherein the right rafter mount is configured to engage a third building rafter located within the stair opening at a location adjacent to the right stringer.

10. The attic stair apparatus of claim 9, wherein the right rafter mount is configured to engage the second rafter at a distance from the stair body upper end equaling ⅓ a length of the stair body.

11. The attic stair apparatus of claim 1, wherein the hinge assembly includes a left joist plate, a right joist plate, a shaft collar, a merchant coupler, and a hinge bar.

12. The attic stair apparatus of claim 11, wherein the left joist plate is connected to the left stringer, the right joist plate is connected to the right stringer, and the shaft collar, merchant coupler, and hinge bar extend between the right joist plate and the left joist plate.

13. The attic stair apparatus of claim 1, further comprising:

a backing that is positioned along a back surface of each of the left stringer, the right stringer and the plurality of stairsteps.

14. The attic stair apparatus of claim 1, wherein the left spring comprises a gas spring.

15. The attic stair apparatus of claim 1, wherein the right spring comprises a gas spring.

* * * * *